US005933697A

United States Patent [19]

Onodera et al.

[11] Patent Number: 5,933,697

[45] Date of Patent: Aug. 3, 1999

[54] IMAGE FORMING APPARATUS WITH CURL GENERATING MEANS

[75] Inventors: Shinichi Onodera, Tokyo; Kunihiko Matsuzawa, Kawasaki, both of Japan

[73] Assignee: Canon Kabushiki Kaisha, Tokyo, Japan

[21] Appl. No.: 08/780,716

[22] Filed: Jan. 8, 1997

Related U.S. Application Data

[63] Continuation of application No. 08/408,282, Mar. 22, 1995, abandoned.

[30] Foreign Application Priority Data

Mar. 24, 1994 [JP] Japan ..... 6-076369
Mar. 28, 1994 [JP] Japan ..... 6-080951

[51] Int. Cl.[6] ..... G03G 15/00; G03G 21/00

[52] U.S. Cl. ..... 399/406; 271/188; 271/242; 399/388

[58] Field of Search ..... 271/242, 188, 271/272, 273; 399/303, 316, 390, 406, 388, 394, 395

[56] References Cited

U.S. PATENT DOCUMENTS

| | | | |
|---|---|---|---|
| 3,920,238 | 11/1975 | Kitajima et al. | 271/9.05 |
| 4,025,187 | 5/1977 | Taylor et al. | 355/317 |
| 4,050,691 | 9/1977 | Ito et al. | 271/311 |
| 4,108,427 | 8/1978 | Komori et al. | 271/9.09 |
| 4,627,718 | 12/1986 | Wyer | 399/406 |
| 4,652,110 | 3/1987 | Sato et al. | 399/406 |
| 4,708,456 | 11/1987 | Shibata et al. | 355/317 X |
| 4,953,037 | 8/1990 | Ito et al. | 358/496 |
| 5,059,988 | 10/1991 | Hisada | 271/188 X |
| 5,078,384 | 1/1992 | Moore | 355/317 X |
| 5,144,385 | 9/1992 | Tani | 399/406 |
| 5,176,373 | 1/1993 | Namba | 271/3.01 |
| 5,209,465 | 5/1993 | Sayama et al. | 271/110 |
| 5,239,347 | 8/1993 | Onodera et al. | 355/274 |
| 5,270,778 | 12/1993 | Wyer | 399/406 |
| 5,362,041 | 11/1994 | Ryuzaki et al. | 271/242 X |
| 5,392,106 | 2/1995 | Bigenwald et al. | 399/406 |
| 5,396,321 | 3/1995 | McFarland | 399/81 |
| 5,414,503 | 5/1995 | Siegel et al. | 399/406 |
| 5,434,029 | 7/1995 | Moser | 430/97 |
| 5,565,970 | 10/1996 | Suda | 399/406 |
| 5,572,308 | 11/1996 | Suda et al. | 399/401 |

FOREIGN PATENT DOCUMENTS

| | | |
|---|---|---|
| 61-282254 | 12/1986 | Japan . |
| 61-295965 | 12/1986 | Japan . |
| 6-64782 | 3/1994 | Japan . |
| 7-172639 | 7/1995 | Japan . |

*Primary Examiner*—William J. Royer
*Assistant Examiner*—Sophia S. Chen
*Attorney, Agent, or Firm*—Fitzpatrick, Cella, Harper & Scinto

[57] ABSTRACT

An image forming apparatus in which a recording medium is conveyed and held to a recording medium holding member by a plurality of conveying roller pairs, the recording medium held is conveyed to a transfer position which faces an image carrying member by a rotation of the recording medium holding member, and a visible image formed on the image carrying member is transferred onto the recording medium is disclosed. The conveying roller pair located at most downstream in the recording medium conveying direction among the plurality of conveying roller pairs are constructed so as to selectively perform rotation/stop of rollers and contact/separation of a nip. At least one of the other conveying roller pairs are constructed so as to selectively perform rotation/stop of the rollers.

23 Claims, 17 Drawing Sheets

IMAGE FORMING APPARATUS WITH CURL GENERATING MEANS

This application is a continuation of application Ser. No. 08/408,282 filed Mar. 22, 1995 now abandoned.

BACKGROUND OF THE INVENTION

1. Field of the Invention

The invention relates to an image forming apparatus such as electrophotographic copying apparatus, electrostatic recording apparatus, or the like, more particularly, to an image forming apparatus for obtaining an image by transferring a visible image such as a toner image formed on an image holding body onto a recording medium held on a recording medium holding member.

Specifically speaking, the invention relates to an image forming apparatus of a recording apparatus using an electrophotographic system, ink jet system, or the like, for example, a printer, a facsimile apparatus, a copying apparatus, or the like.

2. Related Background Art

FIG. 16 shows an example of a conventional image forming apparatus to form a full-color image. According to the image forming apparatus in such an example, a photosensitive drum 1 as an image carrying member is held so as to be rotatable in the direction shown by an arrow. A corona charging device 2, an optical system 3, a developing apparatus 4, a transfer apparatus 5, and a cleaning device 6 are arranged around the photosensitive drum 1.

The optical system 3 is constructed by, for example, a laser beam exposing apparatus, having an original scan section and color separating filters, for irradiating a color separated light image or a light image E corresponding to it onto the photosensitive drum 1. By irradiating the light image E every separation color by the optical system 3 onto the photosensitive drum 1 uniformly primary-charged by the charging device 2, an electrostatic latent image of each color is sequentially formed on the photosensitive drum 1.

The developing apparatus 4 is a rotary developing apparatus and have following four developing devices around a center axis 4*b*: namely, a cyan developing device 4C; a yellow developing device 4Y, a magenta developing device 4M, and a black developing device 4K. A predetermined developing device is rotated and moved to a developing position which faces the photosensitive drum 1 and a latent image on the photosensitive drum 1 is developed, thereby forming a toner image by a toner using a resin as a base substance onto the photosensitive drum 1.

A recording medium is taken out from a recording medium cassette 7 and is fed by a conveying system to the transfer apparatus 5 along a paper path (conveying path) shown by a broken line in the drawing. The toner image formed on the photosensitive drum 1 is transferred onto the recording medium fed to the transfer apparatus 5 at a transfer position which faces the photosensitive drum 1.

In the example, the transfer apparatus 5 has a transfer drum 5*a*. The transfer drum 5*a* is formed by a cylindrical body in which a recording medium holding sheet (transfer sheet) 5*f* made of a dielectric material is suspended in a space area of an outer peripheral surface. A transfer charging device 5*b*, an adsorption charging device 5*c*, an adsorbing roller 5*g*, inside and outside discharging devices 5*d* and 5*e*, and a separation discharging device 5*h* are arranged around the transfer drum 5*a*.

The recording medium supplied from the recording medium cassette 7 to the transfer apparatus 5 via the conveying system is electrostatically adsorbed and held on the holding sheet 5*f* by the adsorption charging device 5*c* comprising corona charging units on the inside and outside of the transfer drum 5*a* and the adsorbing roller 5*g* arranged at a position opposite to the adsorption charging device 5*c*. The recording medium is subsequently conveyed toward the transfer position by the rotation of the transfer drum 5*a*.

At the transfer position, an electric field is applied to the recording medium by the transfer charging device 5*b* comprising a corona charging unit on the inside of the transfer drum 5*a*, whereby the toner image on the photosensitive drum 1 is transferred. The recording medium onto which the toner image was transferred is again conveyed to the transfer position by the rotation of the transfer drum 5*a*, then a toner image of a next color formed on the photosensitive drum 1 is transferred onto the recording medium.

When toner images of four colors are transferred as mentioned above, the recording medium is discharged by the separation discharging device 5*h* on the outside of the transfer drum 5*a* and is separated from the carrying sheet 5*f* by a separating means 8 and is fed to a heat roller fixing device 9. The toner images are color-mixed and fixed onto the recording medium by the heat roller fixing device 9, thereby forming a full-color permanent image. After that, the recording medium is delivered onto a tray 10. On the other hand, residual toners on the surface of the photosensitive drum 1 is cleaned and eliminated by a cleaning device 6, thereafter, the drum 1 is again used for an image forming process.

In the image forming apparatus as mentioned above, generally, a pair of registration rollers 43 as a kind of conveying rollers which can selectively rotate and stop, are provided just before an adsorbing position where the adsorption charging device 5*c* faces the adsorbing roller 5*g*. After a front edge portion of the recording medium conveyed from the recording medium cassette 7 along the conveying path reached a nip entrance portion of the pair of registration rollers 43 in a stop state, the registration roller pair 43 start to rotate at a predetermined timing and feed the recording medium to the adsorbing position.

Before the registration roller pair 43 start to rotate, a pair of conveying rollers 42 on the upstream side of the conveying path also continuously feed the recording medium toward the stopped registration roller pair 43 just after the front edge portion of the recording medium reached the nip entrance portion of the registration roller pair 43, thereby forming a loop of the recording medium between the registration roller pair 43 and the conveying roller pair 42. Even in the case where the recording medium obliquely moves before it reaches the registration roller pair 43, consequently, a whole region of the front edge portion of the recording medium collides with the nip entrance portion of the registration roller pair 43. Simultaneously with the start of the rotation of the registration roller pair 43, the front edge portion of the recording medium coincides with a direction of generating line of the registration roller pair and is fed out from the registration roller pair 43.

However, hitherto, there is a case where a conveying speed of the recording medium that is fed out from the registration roller pair 43 remarkably differs from a peripheral speed of the transfer drum 5*a* or a deviation occurs between the generating lines of the registration roller pair 43 and transfer drum 5*a*. There are consequently problems such that a fluctuation in rotation of the transfer drum 5*a* is caused by a conveying force of the recording medium that is fed out from the registration roller pair 43 or a distortion occurs in the recording medium carrying sheet 5*f*, so that a color deviation, a transfer variation, or the like occurs.

In the case where a curl control of the recording medium is performed in the conveying path on the upstream side than the conveying roller pair 42, if a loop of the recording medium which is formed between the conveying roller pair 42 and the registration roller pair 43 is formed in the direction opposite to a curling direction, there is a problem such that a curl is decreased and an effect of the curl control deteriorates or the like.

To solve the above problems, there has been proposed a method whereby after the front edge portion of the recording medium was fed out, the nip portion of the registration roller pair 43 is away from the recording medium, thereby decreasing a conveying force of the recording medium or releasing the loop.

However, particularly, in the case where a rear edge portion of the recording medium exists on the upstream side than the conveying roller pair 42, there is the following drawback. Namely, just after the front edge portion region of the recording medium starts to adsorb to the recording medium holding sheet 5*f*, if the nip portion of the registration roller pair 43 is away from the recording medium, a deviation occurs in the conveying direction between the front edge portion of the recording medium adsorbed to the holding sheet 5*f* and fed out from the registration roller pair 43 and in which the oblique movement has been eliminated and the rear edge side of the recording medium that is fed out by the conveying roller pair 42. Namely, only the front edge portion of the recording medium is obliquely fed out and the rear edge side is obliquely moved. In such a case, a defective adsorption, a transfer deviation, or the like occurs.

In the image forming apparatus of the type having a plurality of paper feed units as mentioned above, if each unit such as transfer drum, image forming section, or the like is arranged to the optimum position while realizing a compact size of the apparatus, generally, a paper path cannot help becoming a crank-like shape as shown in the drawing. A loop space in front of the registration roller pair is ordinarily provided so as to form a loop toward the inside of a curved portion R before the registration roller pair at a position near the curved portion R as shown in FIG. 17. This is because it is difficult to further provide a space toward the outside thereof since the paper is conveyed along the outside of the curved portion R.

In case of the apparatus of the type such that the recording paper is wrapped around the transfer drum and the image is transferred onto the surface thereof as mentioned above, if there is a slight floating portion or the like in the paper held on the drum, there is a situation such that an adverse influence such as change in image density, transfer blank, or the like is exerted on the transfer image. To avoid such a problem, accordingly, for example, there is used a method whereby a curling mechanism 96 for curling the paper is arranged in the conveying portion before the registration roller pair, thereby curling the paper to easily move along the transfer drum, or the like.

However, the following problems occur in the above apparatus. The curl of an amount which has been once given to the paper in the conveying portion before the registration roller pair so as to be easily moved along the transfer drum is changed by the loop before the registration roller pair. For example, in the apparatus, the curled portion becomes a loop shape as shown in FIG. 17 and the paper P' is bent three times [(1), (2), (3)] while changing the direction of a curvature. Thus, the curl amount of the paper eventually decreases and when the paper is moved along the transfer drum, the front and rear edge portions of the paper easily float from the drum, so that there is a possibility such that an image blank or the like occurs. Or, a phenomenon such that the paper is peeled off from the drum is also considered in accordance with the circumstances.

To prevent such drawbacks, a method of increasing the curl amount to a value more than a necessary amount on the assumption of a change by the loop is also considered. However, it is substantially impossible to uniformly decide such a curl amount for all of the papers having different thicknesses and stiffnesses. (For example, as a stiffness of a paper is large, a change amount of the curl due to the loop is large. As a thickness of a paper is thin, such a change amount is small. Further, such a change amount is also not stable.) When a curl of an amount more than a necessary amount is given, this means that a large performance is requested to the curling mechanism, so that an efficiency is low. When further strictly explaining, since the loop before the registration roller pair is generally formed after the center portion, it doesn't uniformly exert an influence on the whole surface of the paper. The front edge portion is hardly influenced. It will be understood from the above explanation that the loop before the registration roller pair doesn't exert an influence on the curl as much as possible.

In consideration of such a point, there is also a method of reducing a curvature even in the same loop amount by widening the loop space as much as possible. However, it is difficult to assure such a loop space and it results in an increase in size of the apparatus. When the loop amount is simply reduced, there is a limit for the inherent purpose to effect a registration of the paper. Particularly, the use of a plurality of paper feed sections which is a general tendency in recent years causes an increase in length of paper path up to the registration rollers and a complication of the paper path. However, such a structure results in an increase in variation of the paper conveying timing. In order to absorb such a variation as well, a loop of a certain extent is indispensable.

SUMMARY OF THE INVENTION

The invention is made to solve the problems in the conventional apparatus as mentioned above. It is an object of the invention to provide an image forming apparatus in which in order to maintain a good image quality, a loop before registration rollers such that a holding performance for a sheet medium of a transfer drum can be maintained even any kind of sheet medium without exerting an influence on a curl is provided, a registration of the sheet medium is stably applied, and an increase in size of the apparatus is avoided.

Another object of the invention is to provide an image forming apparatus comprising: a conveying section for feeding out a sheet medium supplied from a paper feed section to a registration section after it passed through a paper path having a curved portion; the registration section for forming a loop space by once stopping a front edge of the sheet medium in order to correct an oblique movement of a recording paper and to match a timing with an image and for feeding the recording paper to an image transfer section at a predetermined timing; and a transfer drum, arranged on a downstream of the registration section, for holding the sheet medium on a surface of the drum and for conveying the sheet medium to the image transfer section, wherein a guide member to form an outside of the curved portion of the paper path is movably constructed.

A curling mechanism for giving a curled shape to the sheet medium in the direction along the transfer drum is provided on the upstream side than the curved portion of the paper path in the conveying section. A plurality of such guide members are provided.

Still another object of the invention is to provide an image forming apparatus in which even when a nip portion of a registration roller pair is away from a recording medium just after a front edge portion region of the recording medium has been adsorbed onto a recording medium holding member, a deviation in the conveying direction between the front and rear edge portions of the recording medium does not occur, the recording medium can be stably adsorbed onto the recording medium holding member, the image can be transferred onto the surface of the recording medium, and an image of a high quality without a color deviation or a transfer variation can be obtained.

The above objects are accomplished by an image forming apparatus of the invention. In brief, according to the invention, there is provided an image forming apparatus in which a recording medium is conveyed and held onto a recording medium holding member by a plurality of conveying roller pairs, the held recording medium is conveyed to a transfer position which faces an image carrying member by a rotation of the recording medium holding member, and a visible image formed on the image carrying member is transferred onto the recording medium, wherein the conveying roller pair locating on the downstream side in the conveying direction of the recording medium among the plurality of conveying roller pairs have means for selectively performing rotation/stop of the rollers and contact/separation of a nip, and at least one of the other conveying roller pairs have means for selectively performing rotation/stop of the rollers.

DETAILED DESCRIPTION OF THE PREFERRED EMBODIMENTS

First Embodiment

Figure 1:
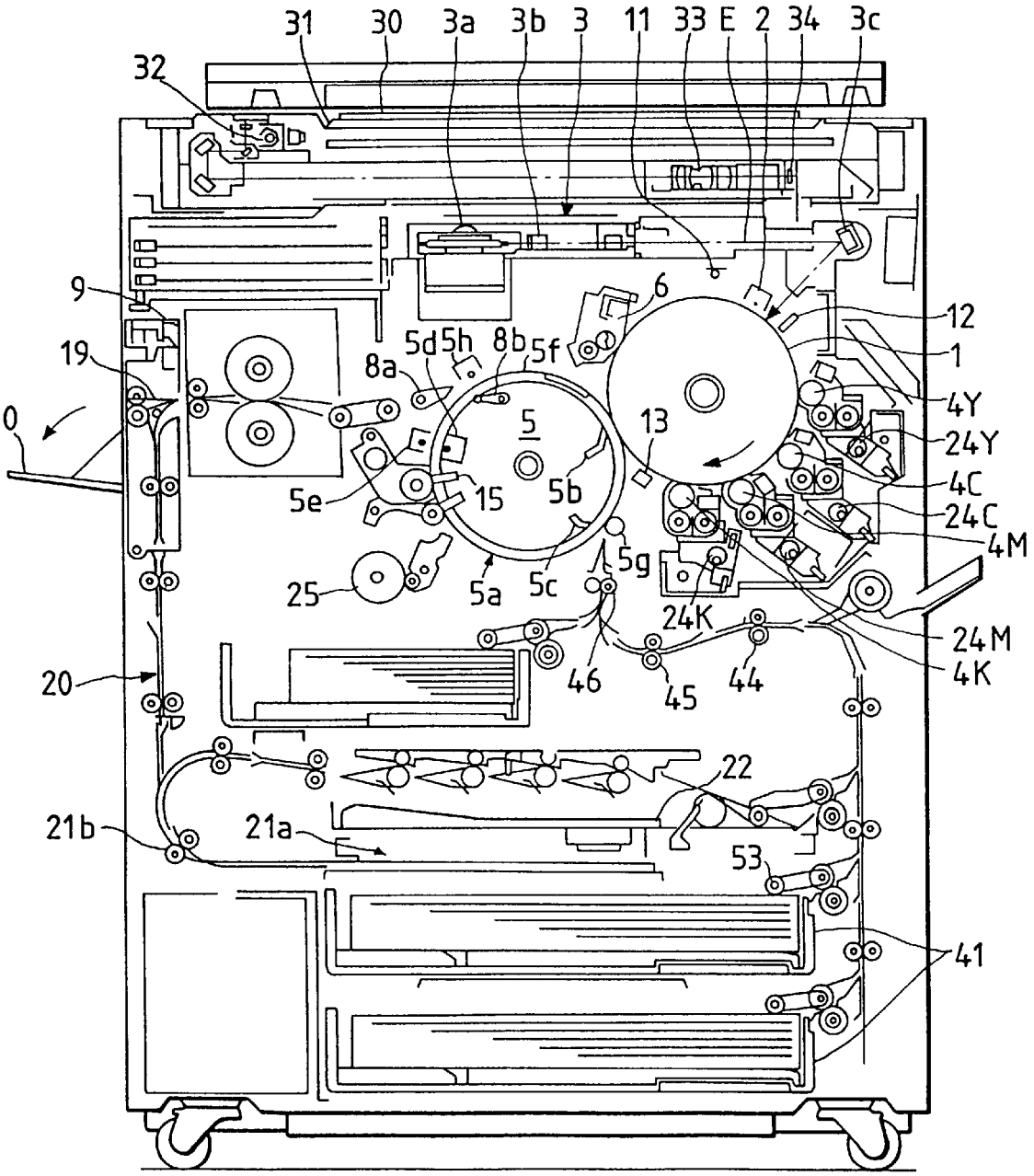
FIG. 1 is a schematic constructional view showing an image forming apparatus according to the first embodiment of the invention.

FIG. 1 is a schematic constructional diagram showing an image forming apparatus to form a color image according to an embodiment of the invention. The image forming apparatus has a digital color image reader section in an upper portion and a digital color image printer section in a lower portion.

In the reader section, an original 30 is put on an original supporting glass plate 31 and is exposed and scanned by an exposure lamp 32, thereby converging a reflected light image from the original 30 onto a full color sensor 34 through a lens 33 and obtaining a color separation image signal. The color separation image signal passes through an amplifying circuit (not shown) and is processed by a video processing unit (not shown) and is sent to the printer section.

In the printer section, the photosensitive drum 1 is held so as to be rotatable in the direction of an arrow. A pre-exposure lamp 11, the corona charging device 2, the laser exposure optical system 3, a potential sensor 12, the four developing devices 4Y, 4C, 4M, and 4K of different colors, means 13 for sensing a light amount on the drum, the transfer apparatus 5, and the cleaning device 6 are arranged around the photosensitive drum 1.

In the laser optical system 3, the image signal from the reader section is converted to the photosignal by a laser output section (not shown). A converted laser beam E is reflected by a polygon mirror 3*a* and passes through a lens 3*b* and is reflected by a mirror 3*c* and is projected onto the photosensitive drum 1.

When the image is formed by the printer section, the photosensitive drum 1 is rotated in the direction of an arrow and is discharged by the pre-exposure lamp 11. After that, the photosensitive drum 1 is uniformly charged by the charging device 2. The light image E is irradiated onto the drum 1 every separation color, thereby forming a latent image onto the photosensitive drum 1.

A predetermined developing device is subsequently operated and the latent image on the photosensitive drum 1 is developed, thereby forming a toner image onto the drum 1. Either one of the developing devices 4Y, 4C, 4M, and 4K is selectively made approach the photosensitive drum 1 in accordance with each separation color by an operation of each of eccentricity cams 24Y, 24C, 24M, and 24K.

The transfer apparatus 5 has the transfer drum 5*a* around which a recording medium holding sheet (transfer sheet) 5*f* made of a dielectric sheet such as a polycarbonate film or the like is provided. The transfer charging device 5*b*, adsorption charging device 5*c*, adsorbing roller 5*g*, inside and outside charging devices 5*d* and 5*e*, and separation discharging device 5*h* are arranged around the transfer drum 5*a*.

The toner images formed on the photosensitive drum 1 are transferred onto the recording medium supplied from the recording medium cassette 7 to the transfer apparatus 5 through the conveying system by a transfer section which faces the photosensitive drum 1. When the toner images of four colors are transferred onto the recording medium, the recording medium is separated from the holding sheet 5*f* by operations of a separating nail 8*a*, a pushing-up roller 8*b*, and the separation discharging device 5*h* and is sent to the heat roller fixing device 9. The transferred toner images on the recording medium are fixed by the heat roller fixing device 9, thereby obtaining a full-color permanent image. After that, the recording medium is delivered onto the tray 10. On the other hand, the residual toners on the surface of the photosensitive drum 1 are cleaned and eliminated by the cleaning device 6. After that, the photosensitive drum 1 is again used for an image forming process.

In case of forming images on both sides of the recording medium, after the recording medium from the fixing device 9 is delivered out, a conveying path switching guide 19 is soon driven and the recording medium is once fed to a reversing path 21*a* through a vertical conveying path 20. After that, the rear edge when the recording medium is fed, is turned to a head by a reverse rotation of a reversing roller 21*b* and the recording medium is moved back in the direction opposite to the feeding direction and is enclosed into an intermediate tray 22. After that, the recording medium is supplied to the transfer apparatus 5 and the image is set to the transfer drum 5*a* side and is adsorbed. An image is formed onto another surface of the recording medium by the foregoing image forming process.

A recording medium conveying system of the image forming apparatus will now be described further in detail. The recording medium fed out from the recording medium cassette 7 passes through a conveying path constructed by a series of conveying roller pairs arranged in series and is sent to an adsorbing position at which the adsorption charging device 5*c* faces the adsorbing roller 5*g*. The recording medium is electrostatically adsorbed onto the recording medium holding sheet 5*f* of the transfer drum 5*a* by operations of the adsorption charging device 5*c* and adsorbing roller 5*g*.

In the conveying path, a second registration roller pair 46 having means which can selectively perform rotation/stop of the rollers and executes contact/separation of the rollers (contact/separation of a nip) at a desired timing are provided just before the adsorbing position. Upstream of the registration roller pair 46, a first registration roller pair 45 which can selectively perform rotation/stop of rollers are provided. Further, a conveying roller pair 44 are provided in an upstream of the first registration roller pair 45. An interval between the adjacent roller pairs of the conveying roller pairs including the registration rollers 46 in the conveying path is set to be shorter than the minimum length of a recording medium that can be used.

The operations of the conveying roller pair 44, first registration roller pair 45, and second registration roller pair 46 will now be described.

Figure 2:
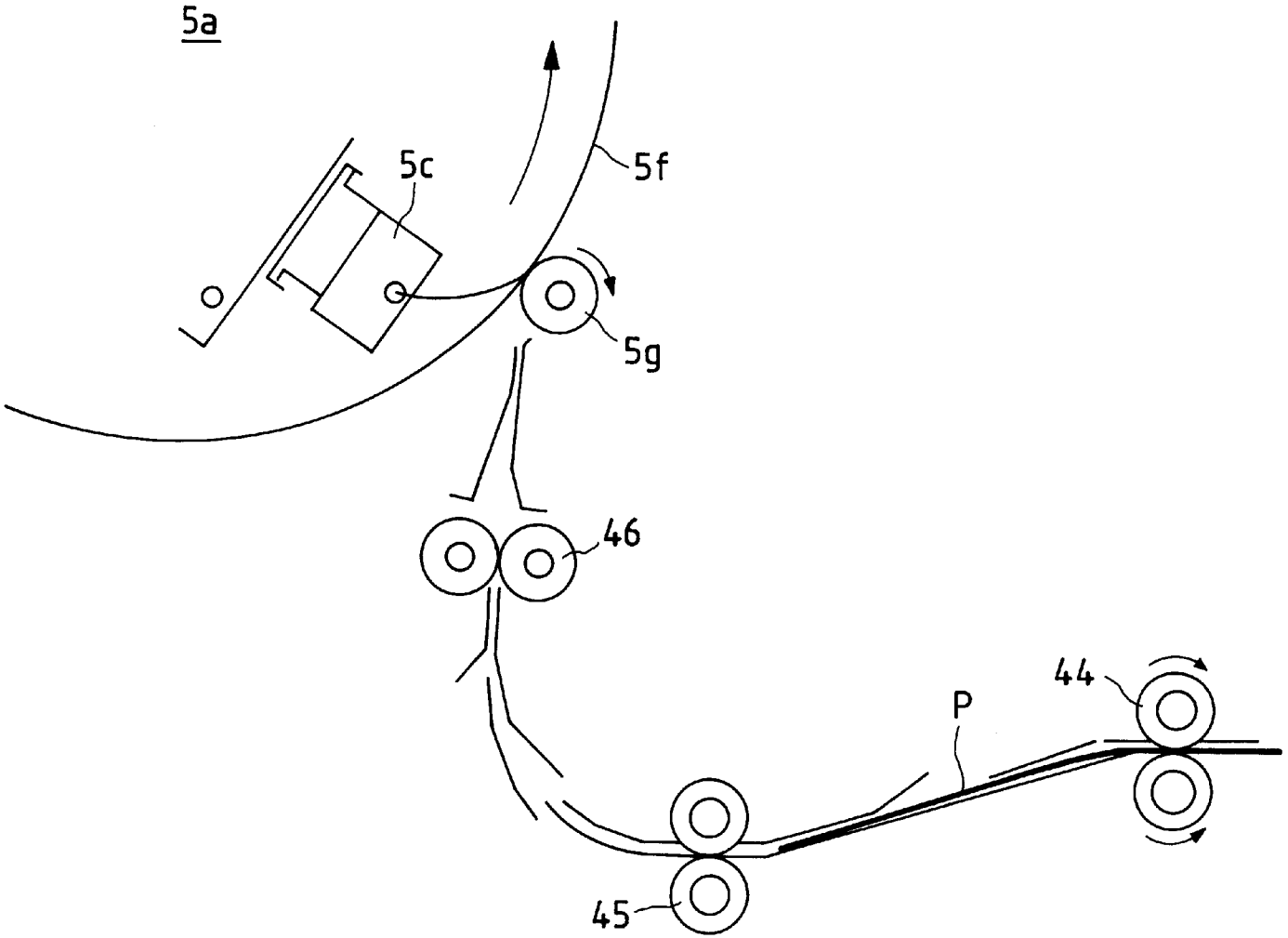
FIG. 2 is an explanatory view showing a part of a recording medium conveyance in the apparatus of FIG. 1.
Figure 3:
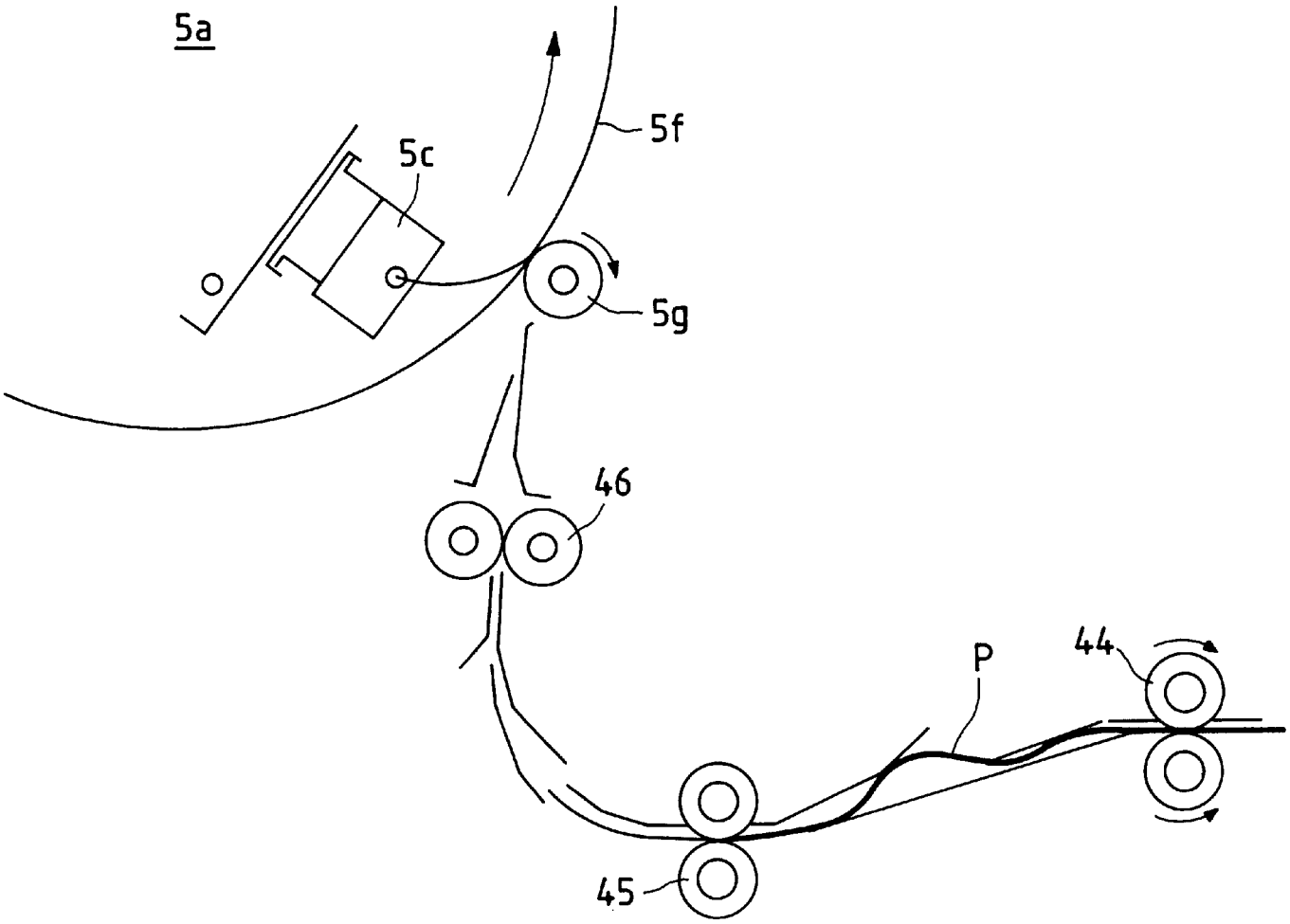
FIG. 3 is an explanatory view showing another part of the recording medium conveyance.

The conveying roller pair 44 is constructed so as to always rotate or to start rotating before the recording medium arrives. As shown in FIG. 2, a recording medium P which reached a nip portion of the conveying roller pair 44 is fed out as it is toward the first registration roller pair 45. In a state in which a front edge portion of the recording medium P collides with a nip entrance portion of the first registration roller pair 45 in a stop state, it is further continuously fed out by the conveying rollers 44. Thus, as shown in FIG. 3, a loop of the recording medium P is formed between the conveying roller pair 44 and the first registration roller pair 45.

Figure 4:
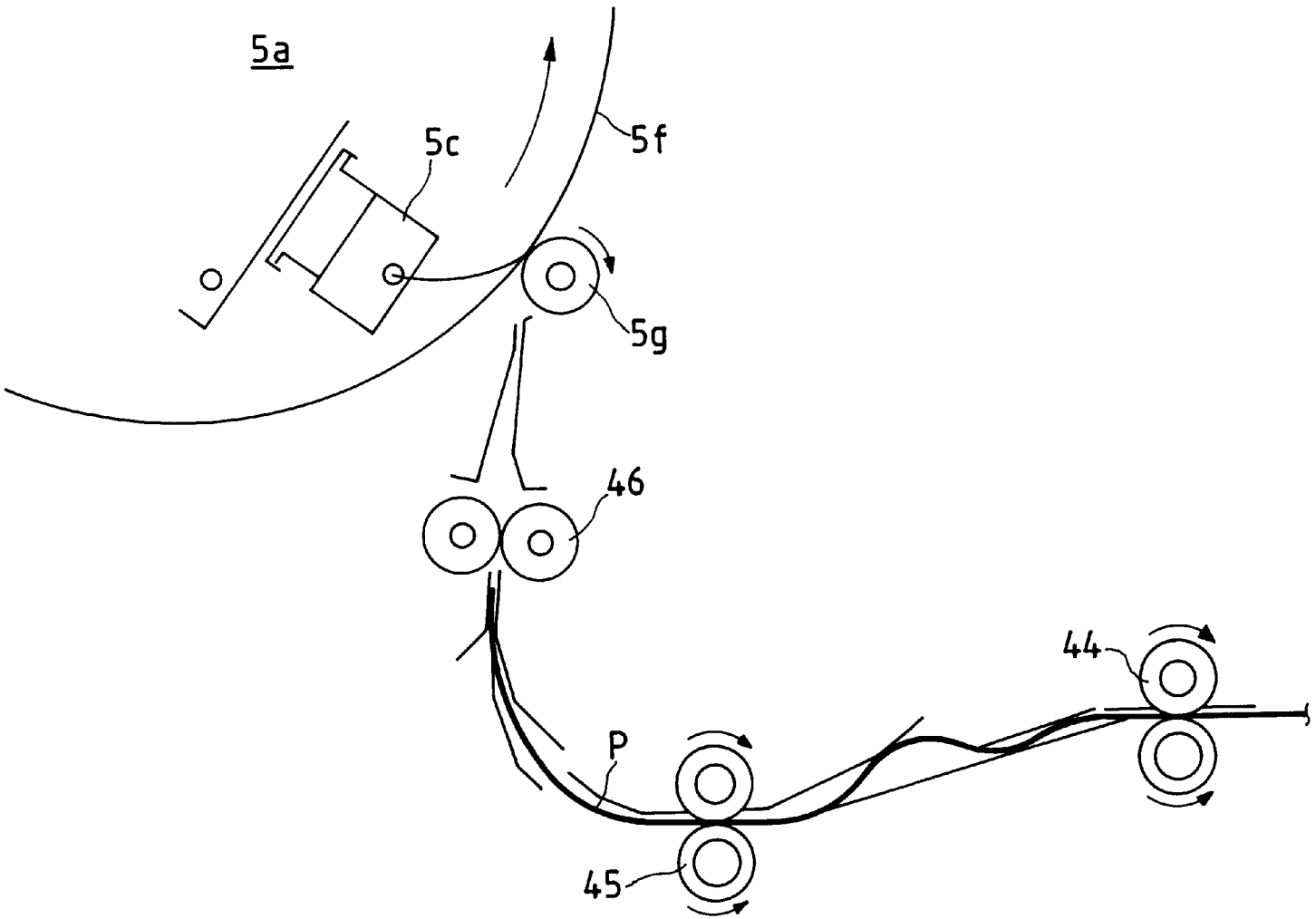
FIG. 4 is an explanatory view showing still another part of the recording medium conveyance.

After that, as shown in FIG. 4, the first registration roller pair 45 start to rotate at a predetermined timing, thereby feeding out the recording medium P toward the second registration roller pair 46. In this instance, even in the case where the recording medium P fed out from the conveying roller pair 44 is obliquely moved, by forming a loop between the conveying roller pair 44 and the first registration roller pair 45, a whole region of the front edge portion of the recording medium P can be made collide with the nip entrance portion of the first registration roller pair 45. Thus, the front edge portion of the recording medium P can be made coincide with the direction of the generating line of the first registration roller pair 45 and can be fed out.

Figure 5:
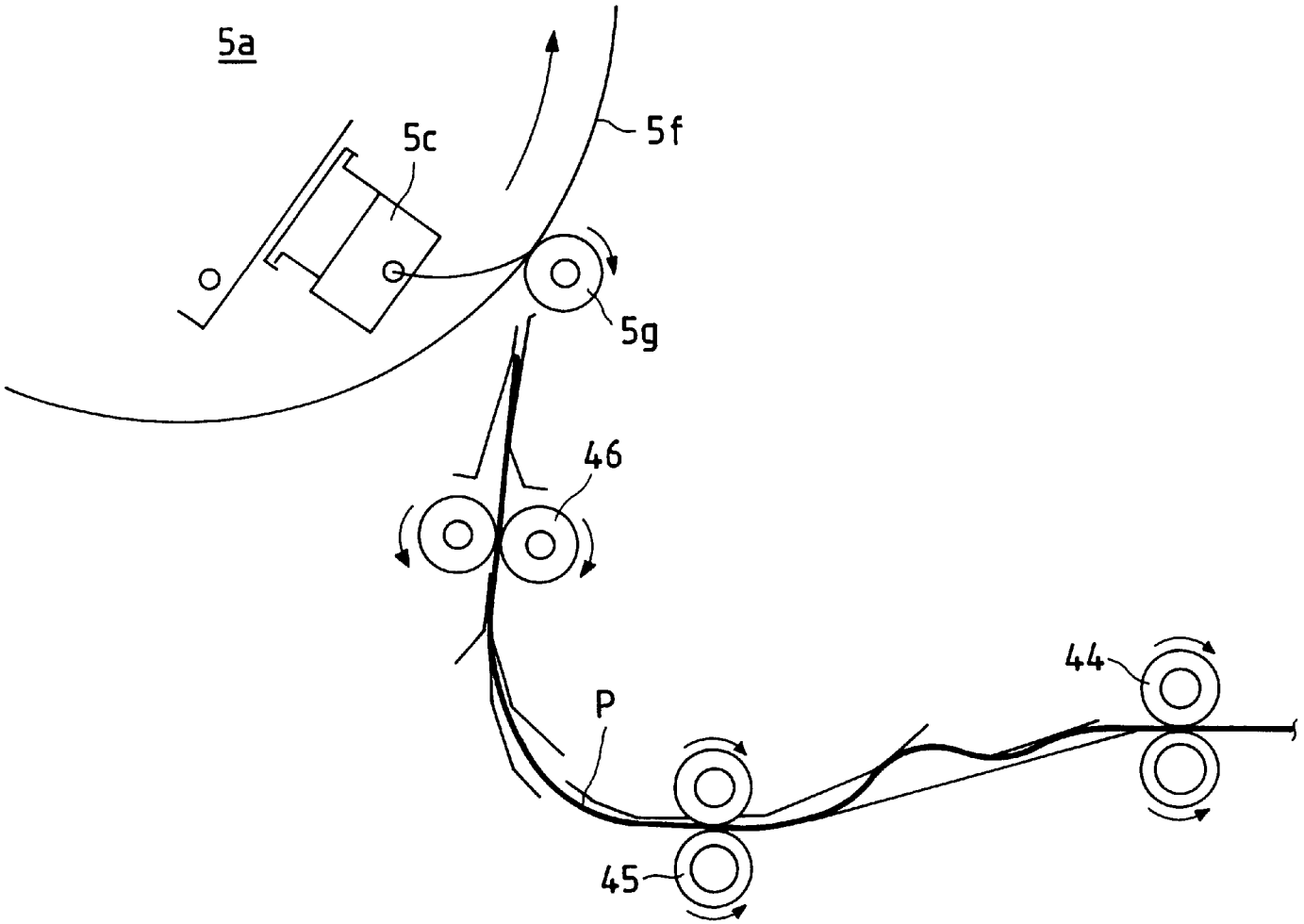
FIG. 5 is an explanatory view showing further another part of the recording medium conveyance.
Figure 6:
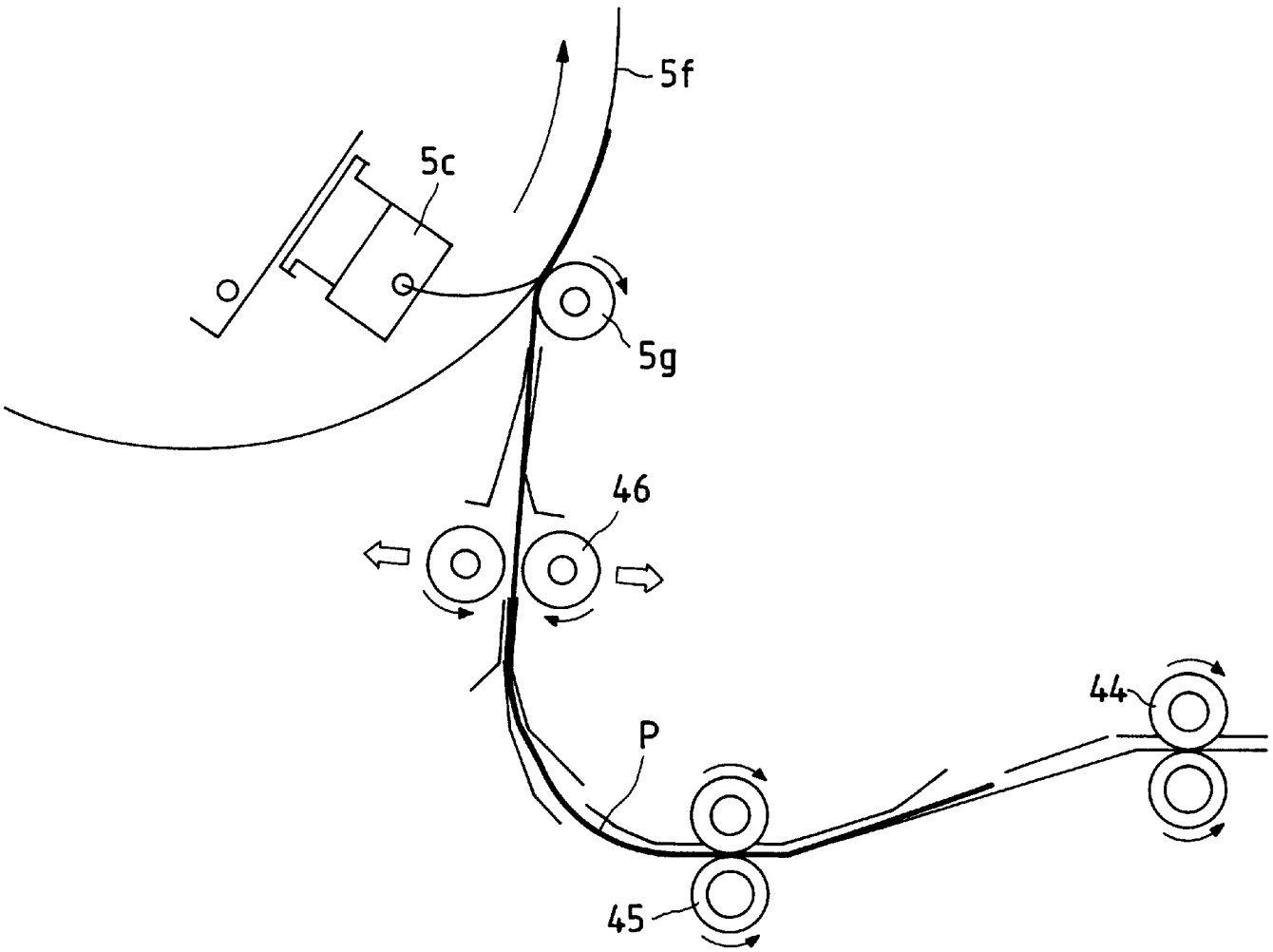
FIG. 6 is an explanatory view showing further another part of the recording medium conveyance.

The recording medium P fed out toward the second registration roller pair 46 collides with the nip entrance portion of the second registration roller pair 46 in the stop state. After that, as shown in FIG. 5, the second registration roller pair 46 starts the rotation at a predetermined timing and the recording medium P is supplied to an adsorbing position on the transfer drum 5*a*. After an electrostatic adsorption of the front edge portion of the recording medium P onto the recording medium holding sheet 5*f* of the transfer drum 5*a* has been started, as shown in FIG. 6, the second registration roller pair 46 is away from the recording medium at a predetermined timing, so that the recording medium P is released from a conveying force of the second registration roller pair 46 and is held and conveyed by the transfer drum 5*a* while being electrostatically adsorbed onto the holding sheet 5*f*.

According to the embodiment as mentioned above, the means for selectively performing the rotation/stop of the rollers and the contact/removal of the nip is provided for the second registration roller pair 46 as a conveying roller pair provided in a bottomstream of the conveying path of the recording medium P. The means for selectively performing the rotation/stop of the rollers is provided for the first registration roller pair 45 as a conveying roller pair provided on the upperstream side than the above means. Therefore, by forming a loop in the recording medium P between the first registration roller pair 45 and the conveying roller pair 44 provided on the upstream side thereof, the oblique movement of the recording paper P is prevented and the recording medium can be fed to the second registration roller pair 46. Thus, even if the nip of the second registration roller pair 46 is away from the recording medium just after the adsorption of the region of the front edge portion of the recording medium P conveyed by the second registration roller pair 46 onto the recording medium holding sheet 5*f* is started, the recording medium P can be sent to the adsorbing position at a predetermined timing without causing a deviation in the conveying direction between the front and rear edge portions of the recording medium P. Therefore, a rotation variation of the transfer drum 5*a* and a distortion of the holding sheet 5*f* due to an influence by the conveying force of the recording medium P can be prevented and a color image of a high quality without a color deviation or a transfer variation can be obtained.

Second Embodiment

Figure 7:
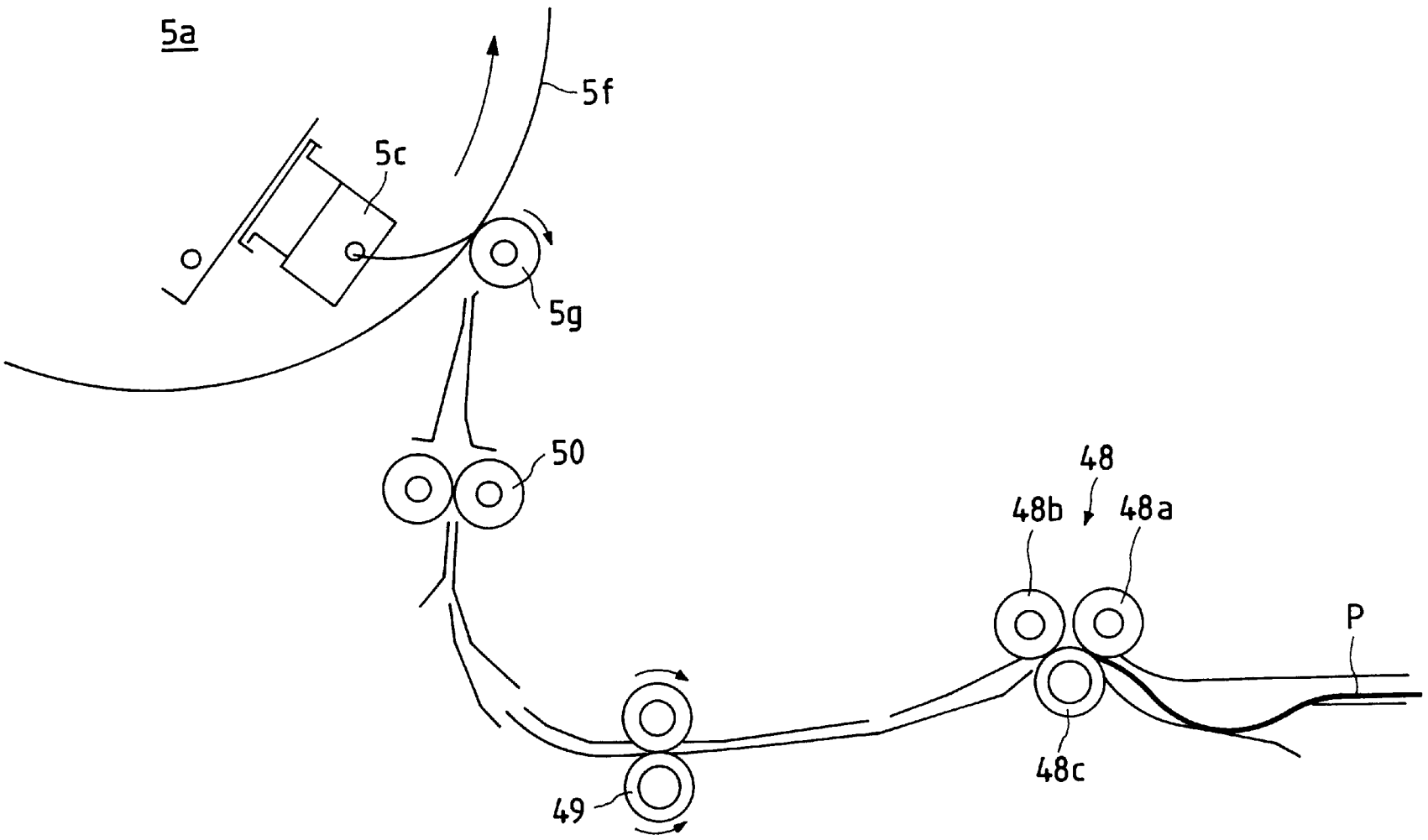
FIG. 7 is an explanatory view showing a part of a recording medium conveyance in another embodiment of the invention.

The second embodiment is characterized in that in the image forming apparatus of the first embodiment shown in FIGS. 1 to 6, a registration roller pair 50, a conveying roller pair 49 which always rotate, and curling conveying rollers 48 are arranged in accordance with this order from the bottomstream side of the recording conveying path as shown in FIG. 7.

In a manner similar to the second registration roller pair 46 in FIG. 1, the registration roller pair 50 have means for selectively enabling rotation/stop of the rollers and contact/removal of a nip to be performed. The curling conveying rollers 48 are constructed by a metal roller 48*c* and two curling rollers 48*a* and 48*b* each made of an elastic member such as a sponge or the like. The curling rollers 48*a* and 48*b* are come into contact with the metal roller 48*c* with a pressure and are driven and rotated. The metal roller 48*c* has means for selectively enabling rotation/stop to be performed. The curling conveying rollers 48 has a construction in which a register and a control function similar to those of the registration roller pair 50 are added.

First, as shown in FIG. 7, a front edge of the recording medium P fed out from the recording medium cassette 7 in FIG. 1 collides with a nip entrance portion of the metal roller 48*c* and curling roller 48*a* in the stop state, thereby forming a loop on its upstream side. By the above operation, the front edge portion of the recording medium P coincides with the generating line direction of the metal roller 48*c* and curling roller 48*a*. After that, the rotation of the metal roller 48*c* is started and the recording medium P passes through a nip portion of the metal roller 48*c* and curling rollers 48*a* and 48*b* and is sent to the conveying roller pair 49. When the recording medium P passes through the curling conveying rollers, a convex curl is given so as to easily move along a circumferential surface of the holding sheet 5*f*.

Figure 8:
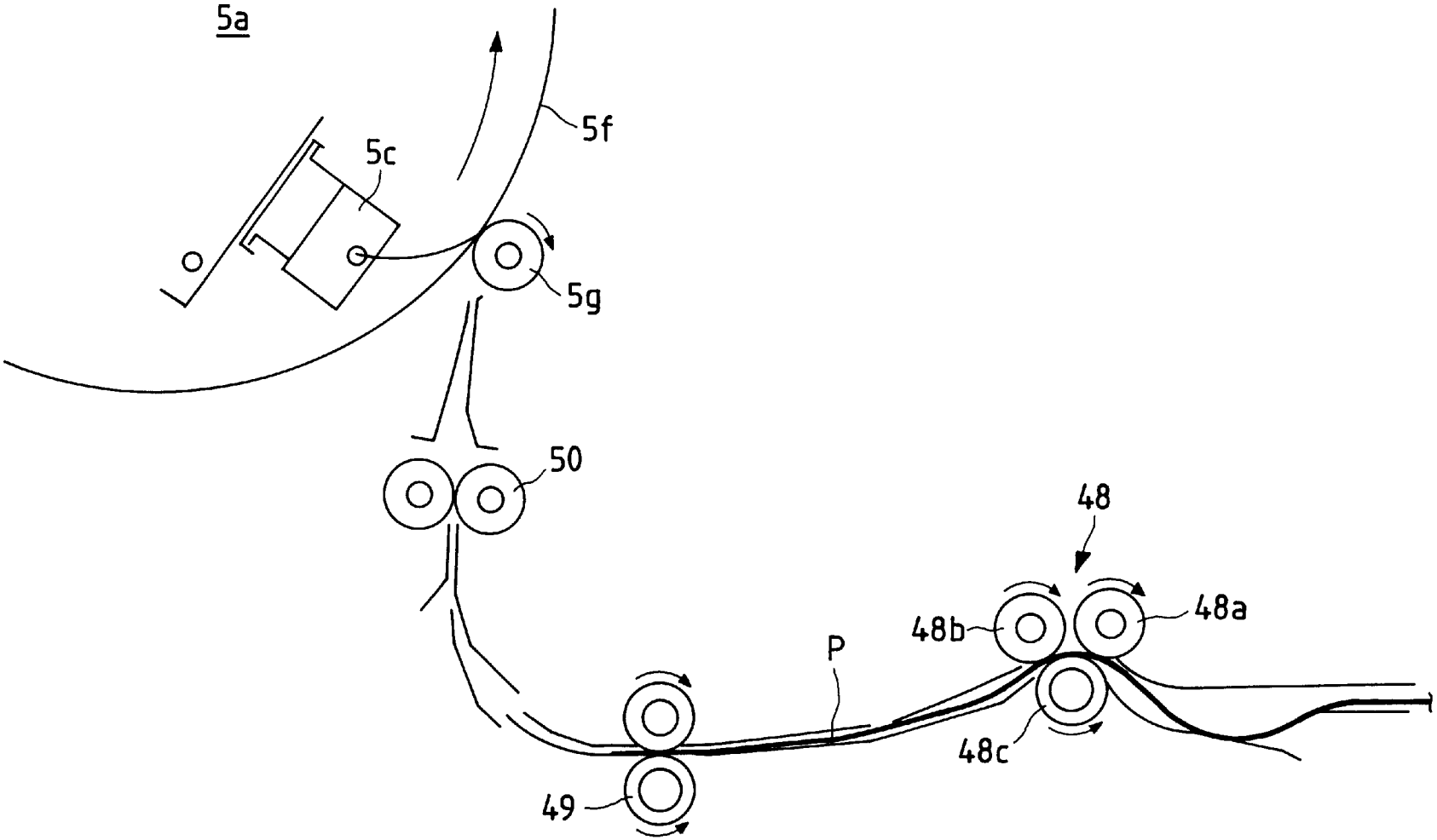
FIG. 8 is an explanatory view showing another part of the recording medium conveyance.
Figure 9:
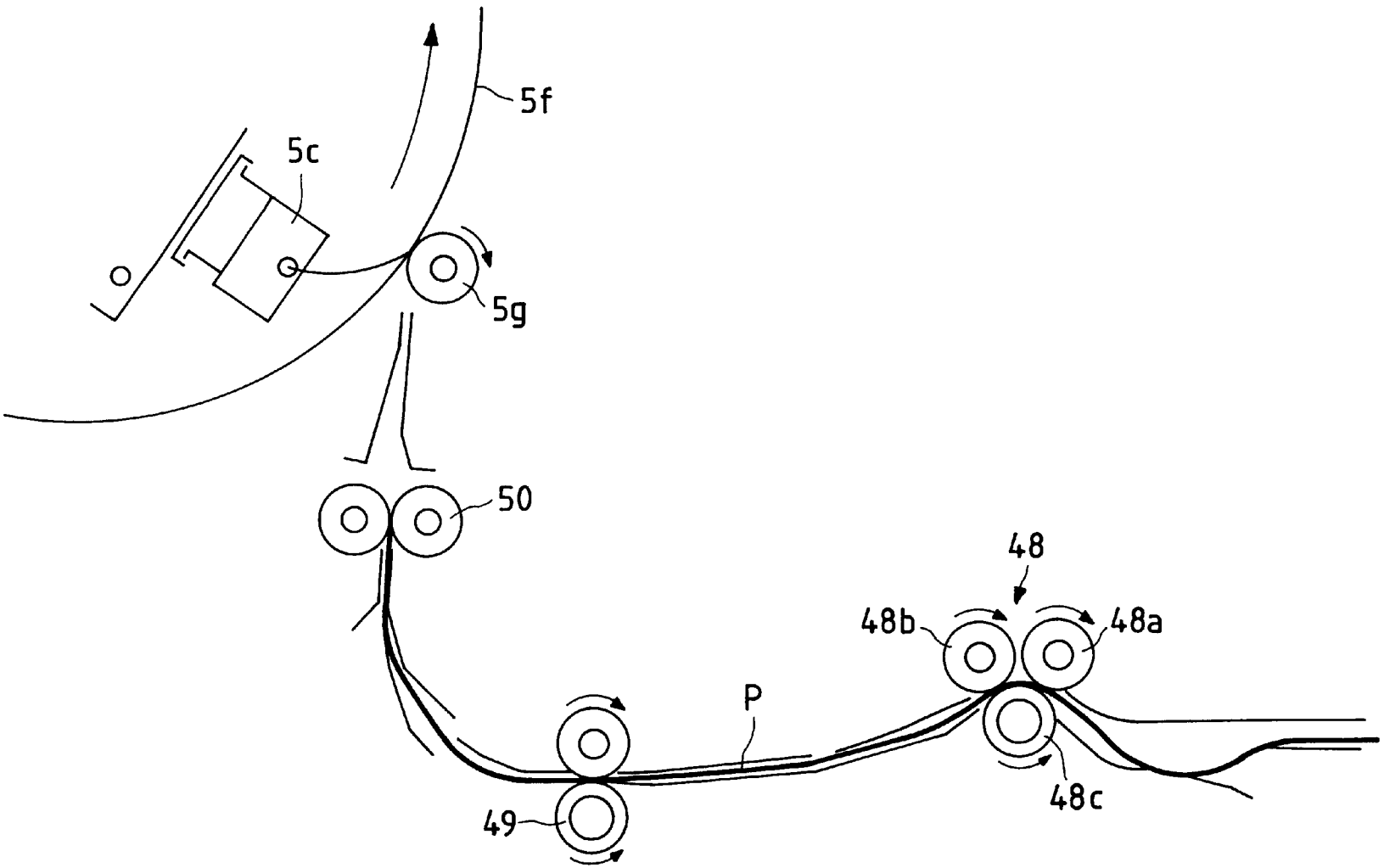
FIG. 9 is an explanatory view showing still another part of the recording medium conveyance.
Figure 10:
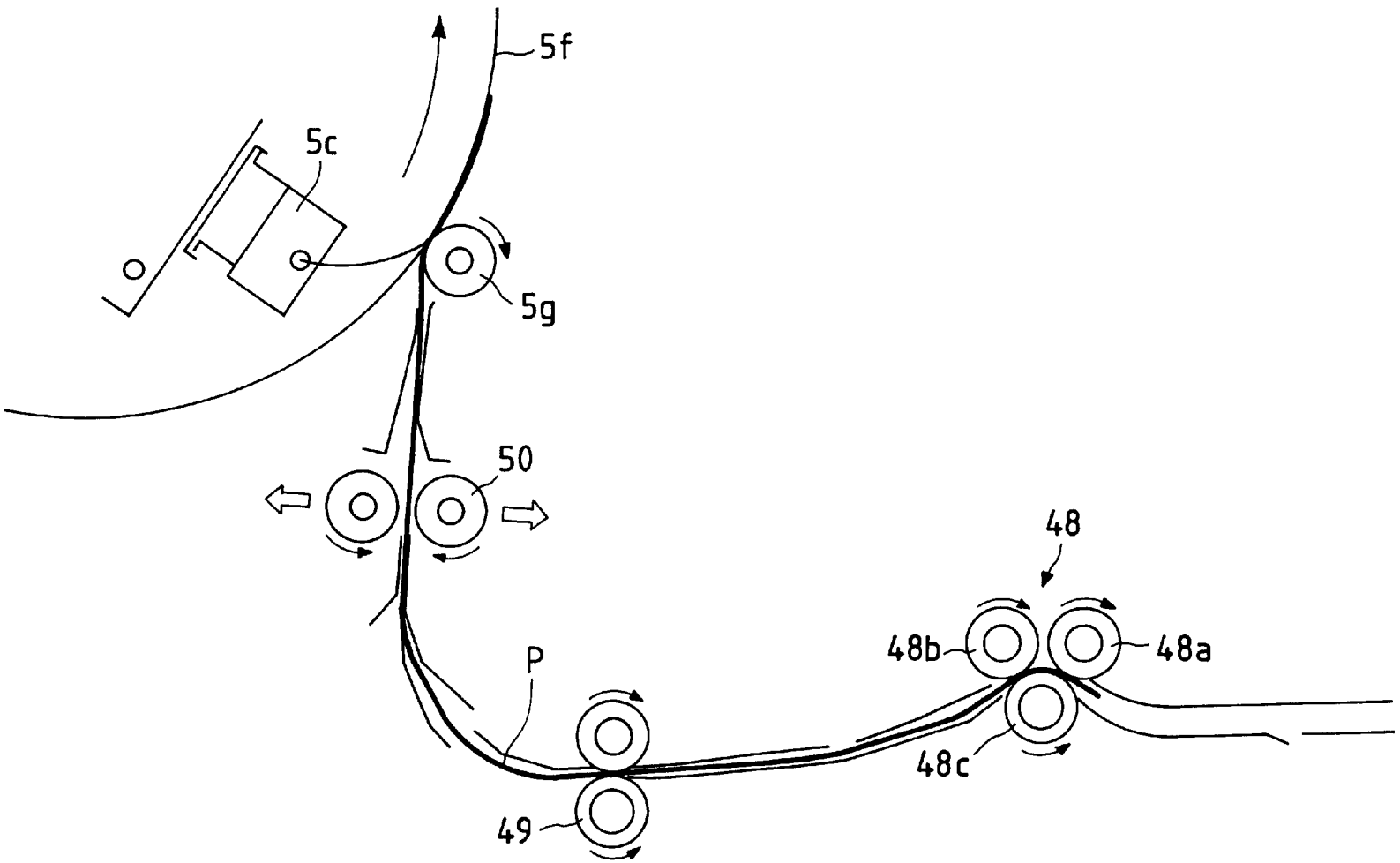
FIG. 10 is an explanatory view showing further another part of the recording medium conveyance.

The curled recording medium P passes through the conveying roller pair 49 which always rotates and is conveyed to the registration roller pair 50 as shown in FIG. 8. A front edge of the recording medium P conveyed to the registration roller pair 50 collides with a nip entrance portion of the registration roller pair 50 in the stop state as shown in FIG. 9. Just after that, the registration roller pair 50 starts the rotation at a timing when a loop amount in which the loop of the recording medium P substantially does not grow is equal to or less than about 3 mm, thereby feeding out the recording medium to the adsorbing position. After the front edge of the recording medium P passed through the adsorbing position, the nip portion of the registration roller pair 50 is away from the recording medium at a predetermined timing as shown in FIG. 10.

As mentioned above, according to the embodiment, since the curling conveying rollers 48 can be selectively rotated/stopped, the loop is formed on the upstream side of the curling conveying rollers 48. An oblique movement of the recording medium P can be prevented and the recording medium P can be conveyed to the recording medium holding sheet 5*f* without losing a curling effect in a drum wrapping direction.

In the above construction, a space such as to form a loop in the same direction as the curling direction of the recording medium P is provided on the downstream side of the curling conveying rollers 48 and upstream side of the conveying roller pair 49. In such a state, by also providing the means which can selectively rotate/stop for the conveying roller pair 49, a further oblique movement preventing effect can be accomplished without losing the curling effect in the drum wrapping direction.

Third Embodiment

Figure 11:
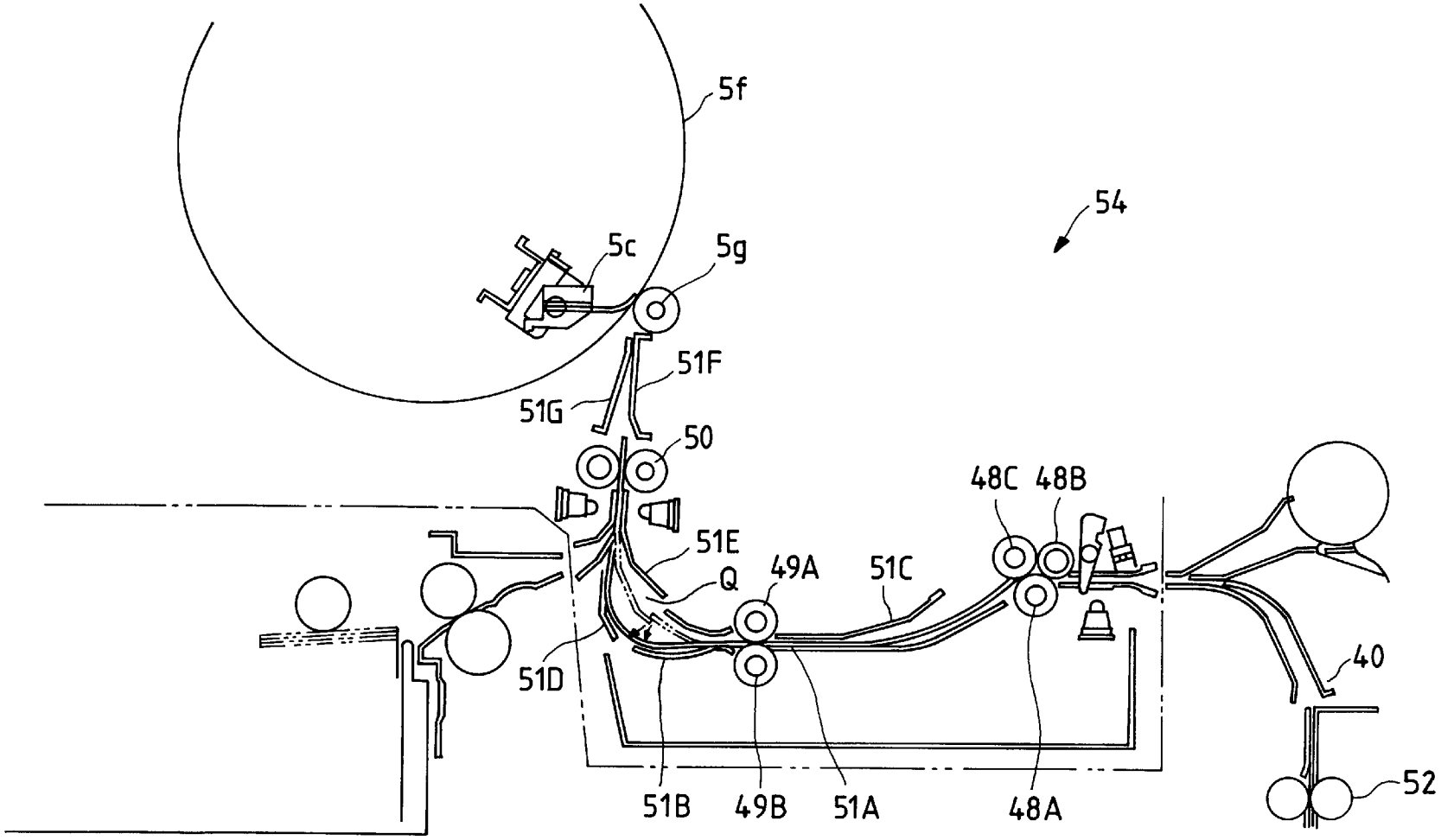
FIG. 11 is a constructional view showing a conveying section of the invention.

In FIG. 11, a conveying section 54 comprises: guides 51A, 51B, 51C, 51D, and 51E for guiding the recording paper fed out from a paper feed unit 40; conveying rollers 48A, 48B, 48C, 49A, 49B; the registration roller pair 50 for feeding out the recording paper to the transfer drum 5*a*, which will be explained hereinlater, in accordance with an image forming timing of an image forming section; adsorbing guides 51F and 51G for guiding the recording paper in this instance; and the like. The conveying rollers 48A, 48B, and 48C have a curling function in the drum wrapping direction. The guides 51B and 51D have an R shape in order to change a progressing direction of the recording paper and are also supported so that they can be swung in the direction of arrows shown in the drawing (hereinafter, those guides are referred to as movable guides). The movable guides are provided to assure a loop space of the paper P which is caused when the front edge of the recording paper is once stopped by the registration rollers.

The adsorbing roller 5*g* is supported at a position where the recording paper that is fed out from the registration roller pair 50 enters the transfer drum so as to be removed from or come into contact with the transfer drum 5*a*. A backup member to withstand a pushing force of the rollers and the adsorbing charging device 5*c* are arranged on the opposite side of the adsorbing roller so as to sandwich the film.

When a signal to start the image forming operation is generated, a cam 25 is rotated by a half rotation, so that the transfer drum 5*a* is swung to an operating position and is rotated synchronously with the photosensitive drum 1. At the same time, the recording paper P is fed out one by one from a cassette 41 by pickup rollers 53 (refer to FIG. 1). The recording paper is guided between the paper feed guides and is conveyed to the conveying section 54 by paper feed rollers 52 and conveying rollers 49A and 49B. In the conveying section 54, when the recording paper passes through the curling rollers 48A, 48B, and 48C, it is curled by a predetermined amount in the wrapping direction of the transfer drum. After that, the recording paper is conveyed to the registration rollers 50 while changing the conveying direction by operations of the conveying rollers 49A and 49B and guide members. In this instance, the registration rollers 50 are stopped and the front edge of the recording paper collides with the nip portion. After the elapse of a predetermined time, the driving of the conveying rollers is stopped. Thus, a loop occurs in the recording paper during such a period of time. However, a loop space Q which is necessary for such a loop, is formed by swinging motions of the movable guides 51B and 51D as guide members [loop space is automatically pressed and widened by a stiffness of the recording paper (refer to the Q portion in FIG. 11)]. In the embodiment, a loop amount before the registration roller pair is set to 7 mm (this value indicates an amount when the recording paper is further fed after the front edge of the recording paper collided with the registration rollers 50). When the recording paper is obliquely moved and reaches the registration section, such a loop amount is necessary to correct such an oblique movement. After that, the registration rollers 50 and conveying rollers start to rotate after the elapse of a predetermined time while setting a timing when the image forming section starts to form an image to a reference. The rotating timing is set so that the positions of the recording paper and the toner image on the photosensitive drum just coincide in an image transfer region.

When the recording paper enters the transfer drum 5*a* and is come into contact therewith, the recording paper is electrostatically adsorbed onto the recording paper holding sheet film by operations of a corona discharge from the adsorbing charging device 5*c* and the adsorbing roller 5*g* (the adsorbing roller 5*g* is ordinarily away from the transfer drum so as to reduce a load and is come into contact with the transfer drum with a pressure only when the recording paper enters). The transfer drum rotates synchronously with the photosensitive drum and the recording paper is conveyed to the image transfer region while it is held on the transfer drum. After the toner image formed on the photosensitive drum by the foregoing processes is transferred onto the surface by the transfer charging device 5*b*. After that, the recording paper is conveyed to a separating section, by which an image of one color is transferred by one time. Therefore, in case of a monochromatic image, the recording paper is separated by an operation, which will be explained hereinlater. However, in case of forming a multi-color image, the separating operation is not performed but the recording paper is held on the transfer drum and, in this state, the paper is rotated by one rotation and is again conveyed to the transfer region. A next toner image is further transferred onto the previous image. The above processes are repeated a necessary number of times.

After completion of the above transfer operations, an adsorbing force between the recording paper and the holding sheet film is reduced by the operation of the discharging device in the separating section. The recording paper is separated from the transfer drum by operations of a subsequent separating nail and the like.

The recording paper separated from the transfer drum is conveyed to a fixing roller section by a conveying belt and is accurately guided to its nip portion on an entrance guide. The toner image is fixed onto the surface of the recording paper by a heat of rollers. After that, the recording paper is conveyed by delivery rollers and is ejected out of the apparatus. Finally, the transfer drum is away from the photosensitive drum (refuge position) and the apparatus stops.

In the apparatus, the loop space before the registration roller pair is formed by swinging two guides on the outside of the paper path curved portion. This point will be further described in detail hereinbelow.

Figure 12A:
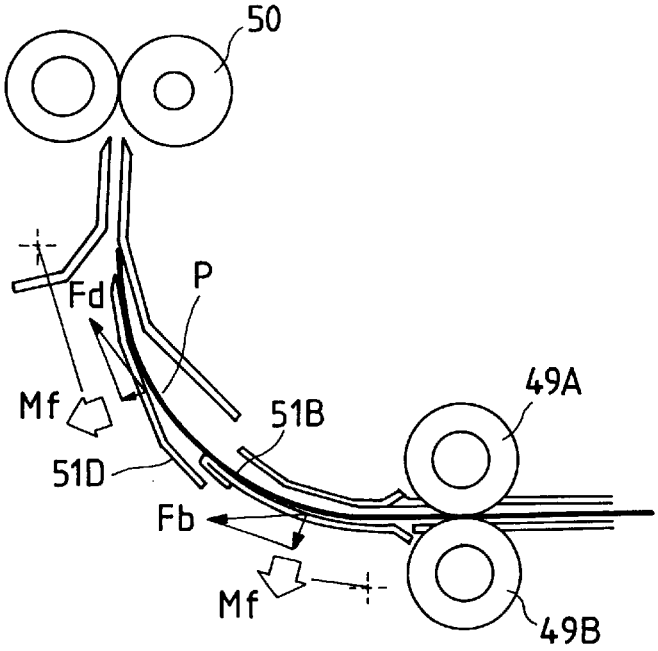
FIGS. 12A and 12B are explanatory views showing relations among forces which act on a swinging guide in the third embodiment.
Figure 12B:
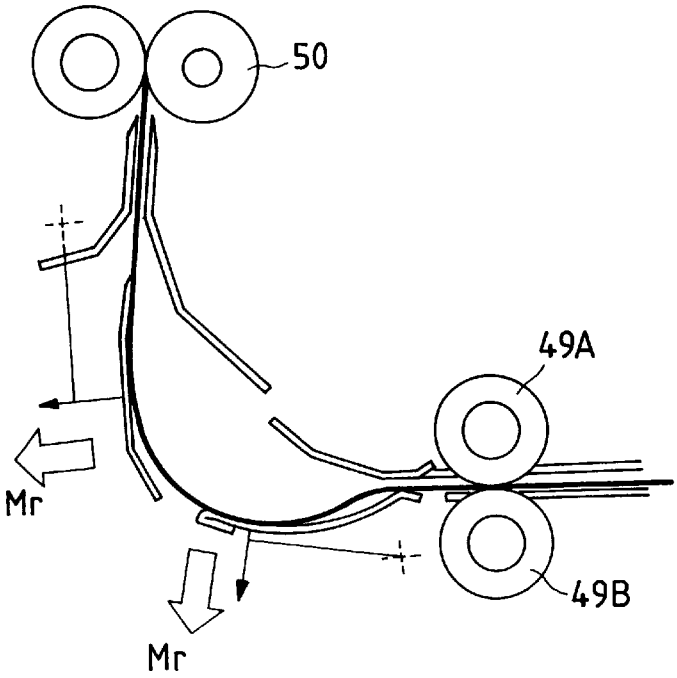

As also mentioned in the conventional apparatus, this is because when a loop is formed toward the inside of the curved portion, the recording paper is curved a few times and its curvature also decreases, so that the curling effect by the curling rollers largely deteriorates, and on the contrary, when a loop is formed on the outside of the curved portion, a curvature is large and it is sufficient to curve the recording paper only once, so that the curling effect does not so largely deteriorate and a predetermined curl amount can be stably maintained. The reasons why the construction using two swinging guides is used will now be explained hereinbelow. First, when the recording paper collides with the registration rollers and a loop is formed, the guides must swing while being overcome with a force in this instance. On the other hand, when the front edge of the recording paper enters, a force to press the guides acts. However, the guides must not swing while being overcome with such a force. Further, such conditions need to be always satisfied for various recording papers of different stiffnesses. The direction of a curl that is given by the curling rollers is opposite to a curving direction of the guides. Particularly, as mentioned above, since a curl amount of a recording paper of a high stiffness is large, in case of such a recording paper, a force to press the guides upon entering is equal to or larger than an increase amount of the stiffness. It is eventually difficult to satisfy the conditions mentioned above by the construction in which one guide is swung. In the embodiment, therefore, two swinging guides are used. Consequently, center positions of swings of the two swinging guides can be selected in a manner such that angular moment Mf which is generated by a force in the pressing direction of the guides at the time when the front edge of the recording paper enters is reduced as small as possible as shown in FIG. 12A (Fb and Fd in the drawing denote forces in the conveying direction of the recording paper and the angular moment Mf is generated from a component force in the rotating direction of the guide in those forces) and that a moment Mr which is generated when the guides are pushed and widened at the time when a loop of the recording paper is formed is increased as large as possible as shown in FIG. 12B. The above conditions, therefore, can be accomplished.

Figure 13:
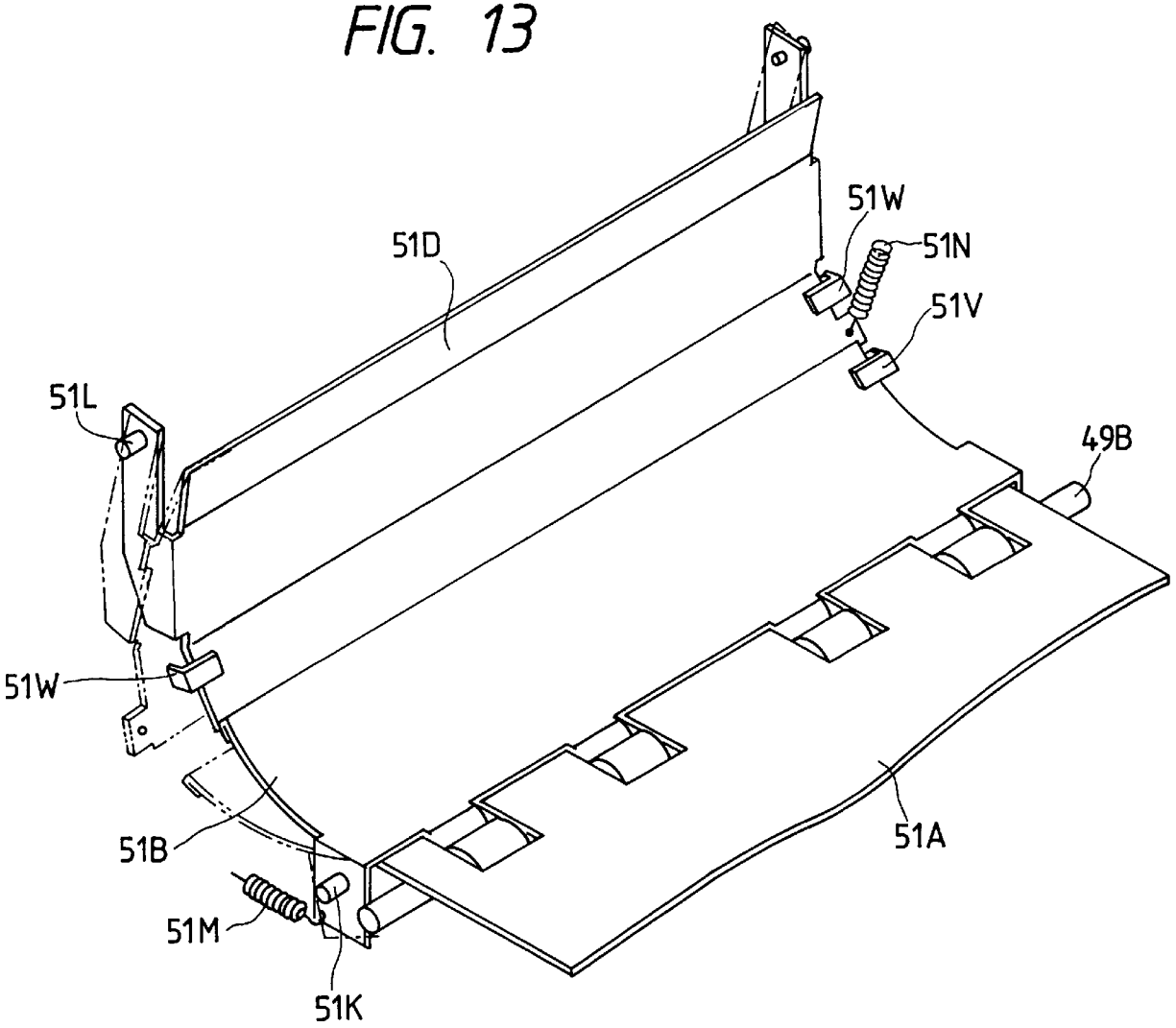
FIG. 13 is a perspective view showing a construction of the swinging guide in the third embodiment.

A construction of a guide section will now be specifically explained with reference to FIG. 13. The fixed guides 51C and 51E and a conveying roller 49A on the inside of the curved portion are omitted in the drawing. The movable guides 51B and 51D are supported to a unit side plate (not shown) so that they can freely swing around center axes 51K and 51L as centers, respectively. The movable guides 51B and 51D are urged upward by forces of springs 51M and 51N and collide with stoppers 51V and 51W projecting from the unit side plate and are stopped, respectively. The spring forces are set in a manner such that when the recording paper enters, the urging forces overcome a pushing force of the paper, so that the guides do not swing, and after that, when the recording paper forms a loop, the urging force is overcome with the paper pushing force, so that the guides are swung as shown by alternate long and two short dashes lines in the drawing. Actually, an acting force when the paper enters for the guide 51B is larger than that for the guide 51D. A loop space is mainly formed by a swing of the movable guide 51D. Therefore, an urging torque of the movable guide 51B is set to a value that is slightly stronger than that of the movable guide 51D. However, since they differ depending on a construction of the system that is embodied, a paper path shape, or the like, the set values of the urging torques are not limited to those mentioned above.

By embodying the present invention in the construction mentioned above, the following effects are obtained.

After a curl is given to the recording paper, the curl is not so largely decreased by the loop before the registration roller pair. A stable curl amount can be maintained. Thus, the recording paper can be held in a good state in which a floating or the like of the recording paper does not exist on the transfer drum. An image of a high quality without a transfer blank or the like can be obtained. Further, the invention can be cope with many kinds of recording papers of different stiffnesses. An increase in size of the apparatus can be prevented.

Fourth Embodiment

In the third embodiment, the loop amount before the registration roller pair has been set to 7 mm. In the fourth embodiment, however, by reducing a loop amount, a curl of the recording paper is further stabilized. It is an object of the loop before the registration roller pair to generate a force to push the front edge of a recording paper when the recording paper which was obliquely moved is made collide and is corrected. For this purpose, in a portion from the loop portion of the recording paper to the front edge thereof, a degree of freedom of a certain degree has to be provided not only a progressing direction but also a width direction (direction perpendicular to the progressing direction). However, as compared with a case of forming a loop into a free space toward the inside in the paper path curved portion, according to a construction in which a loop is formed on the outside while pushing and widening the guides, the surface of the recording paper is in contact with the guides, so that a degree of freedom in the width direction of the recording paper is limited by a friction. Although the spring force of the movable guides further becomes a force to push-in the recording paper, a loop amount on the side which early reached a registration nip due to the oblique movement of the recording paper is larger than that on the opposite side. Thus, the spring force of the guides acts on only the side which early collides with the nip (because the guides are stiff) and hardly contributes to a correction of the oblique movement.

Figure 14:
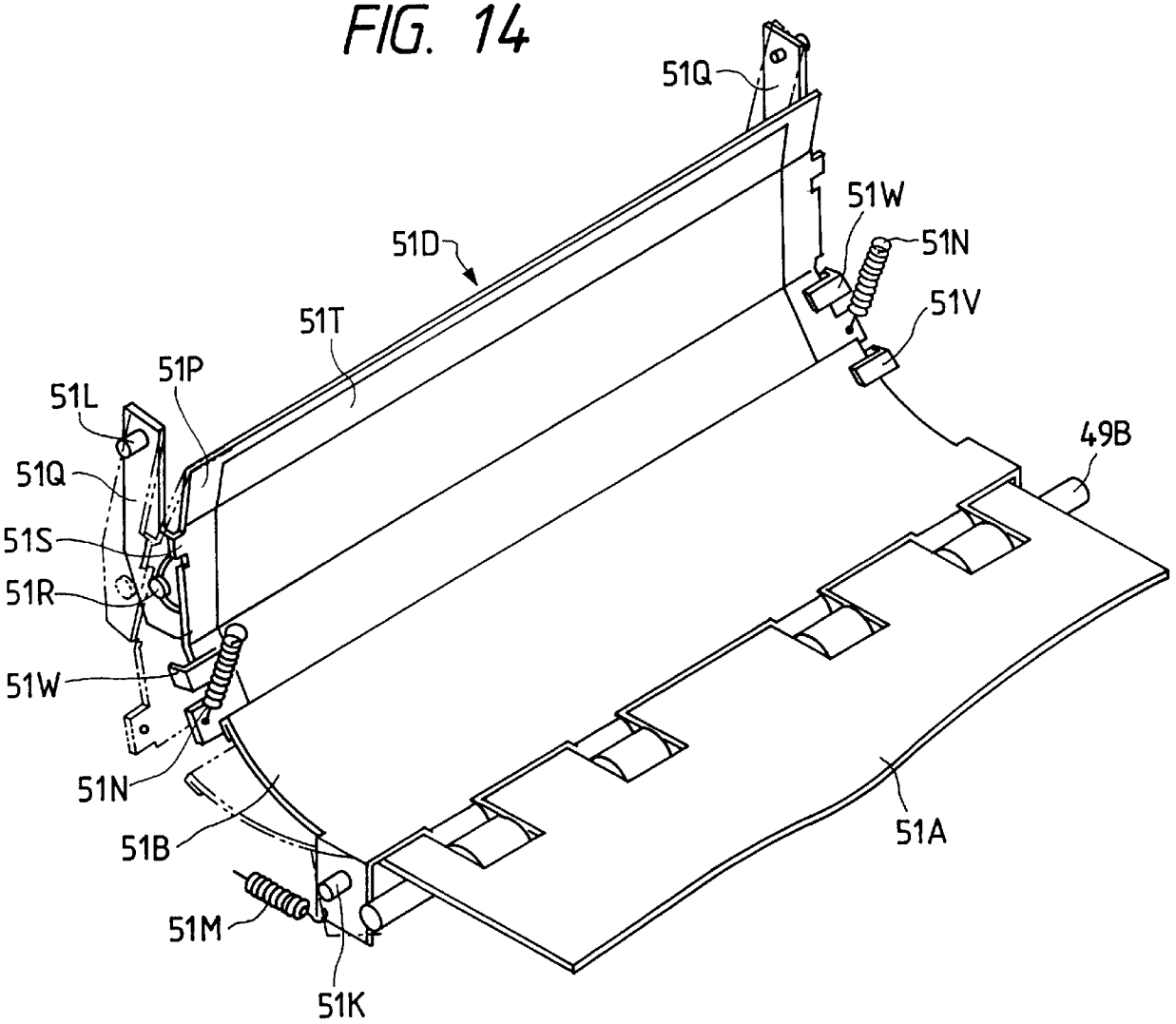
FIG. 14 is a perspective view showing a construction of a swinging guide in the fourth embodiment.

In consideration of the above points, the invention is embodied by using movable guides with a construction as will be explained below. FIG. 14 shows the details of the construction (portions having functions similar to those in FIG. 13 are designated by the same reference numerals and their descriptions are omitted here).

The movable guide 51D is further divided into a guide section 51P and a guide arm 51Q and both of them are coupled by a shoulder vis 51R. Therefore, the guide section 51P is rotatably supported to the guide arm around the shoulder vis as a rotational center. A spring is hooked to both sides of the guide. For the direction in which the guide section is rotated by the spring force, a projection 51S of the guide section collides with the guide arm, so that its rotation is restricted. Further, a sheet 51T (for example, high density polyethylene sheet or the like) of a low coefficient of friction for the recording paper is adhered on the guide surface.

Figure 15A:
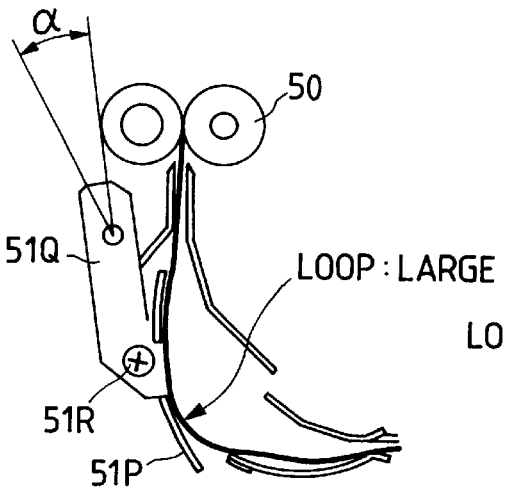
FIGS. 15A, 15B, and 15C are explanatory views showing a feature of the swinging guide in the fourth embodiment.
Figure 15B:
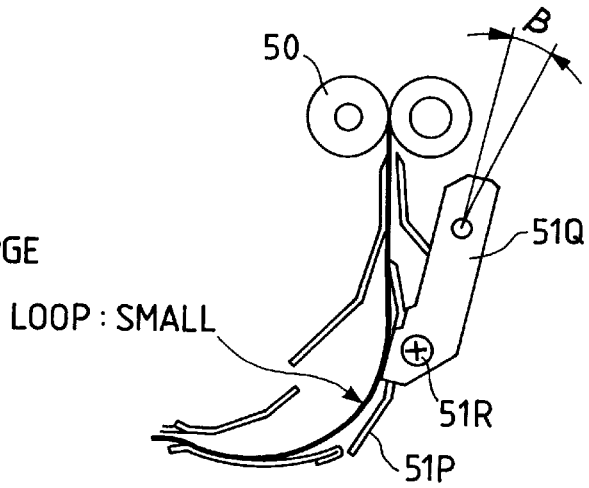
Figure 15C:
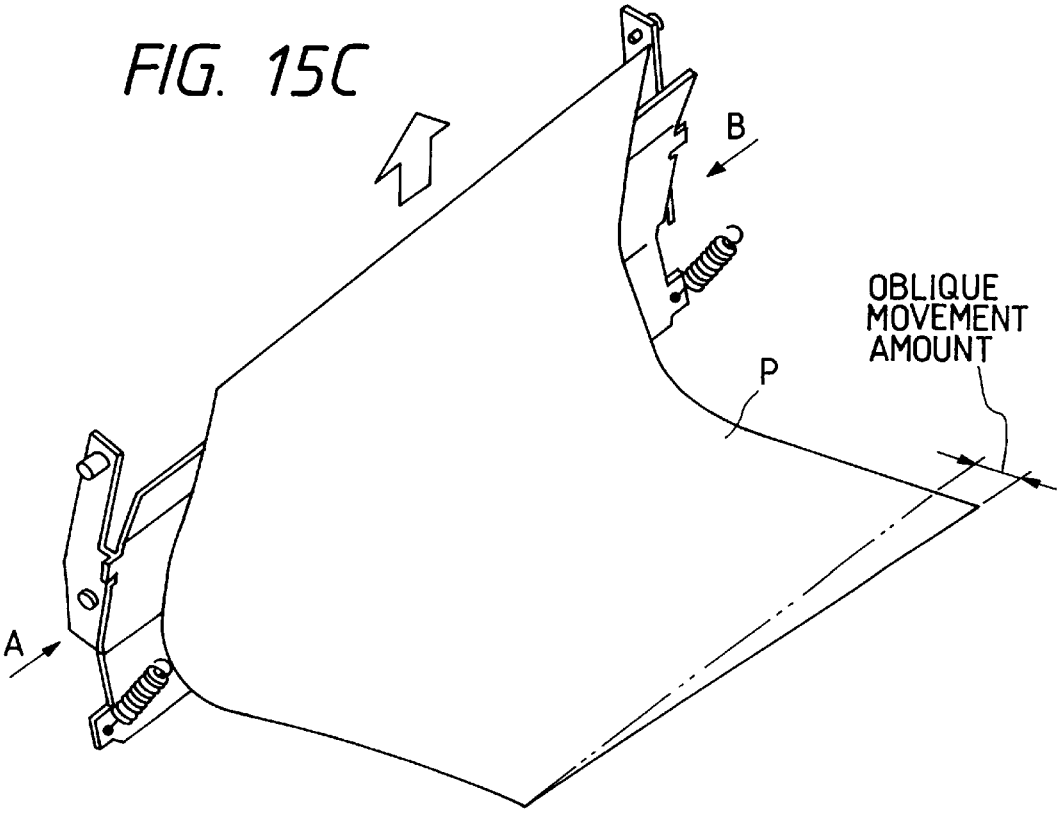
Figure 16:
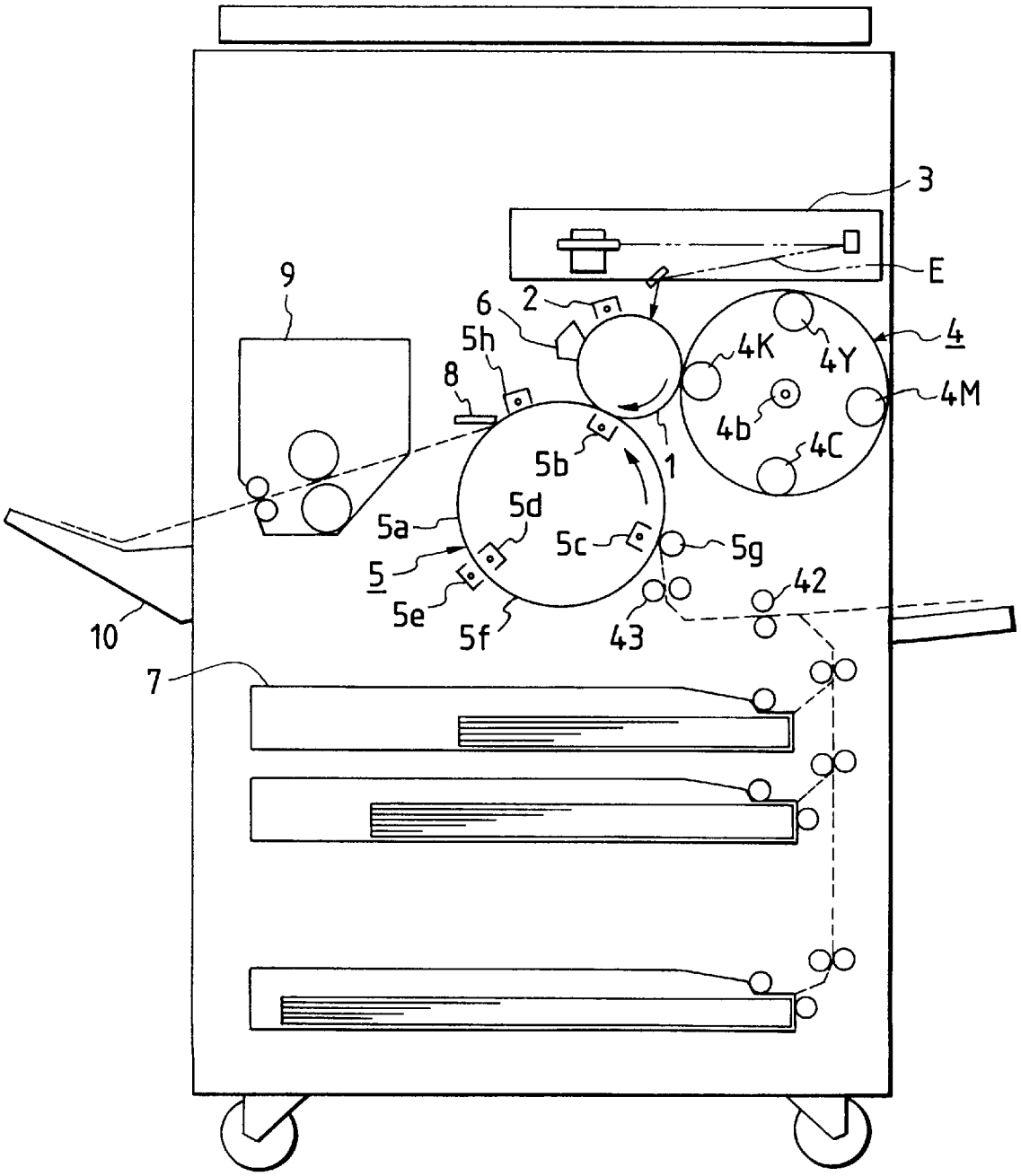
FIG. 16 PRIOR ART
FIG. 16 is a cross sectional view showing a construction of a conventional apparatus.
Figure 17:
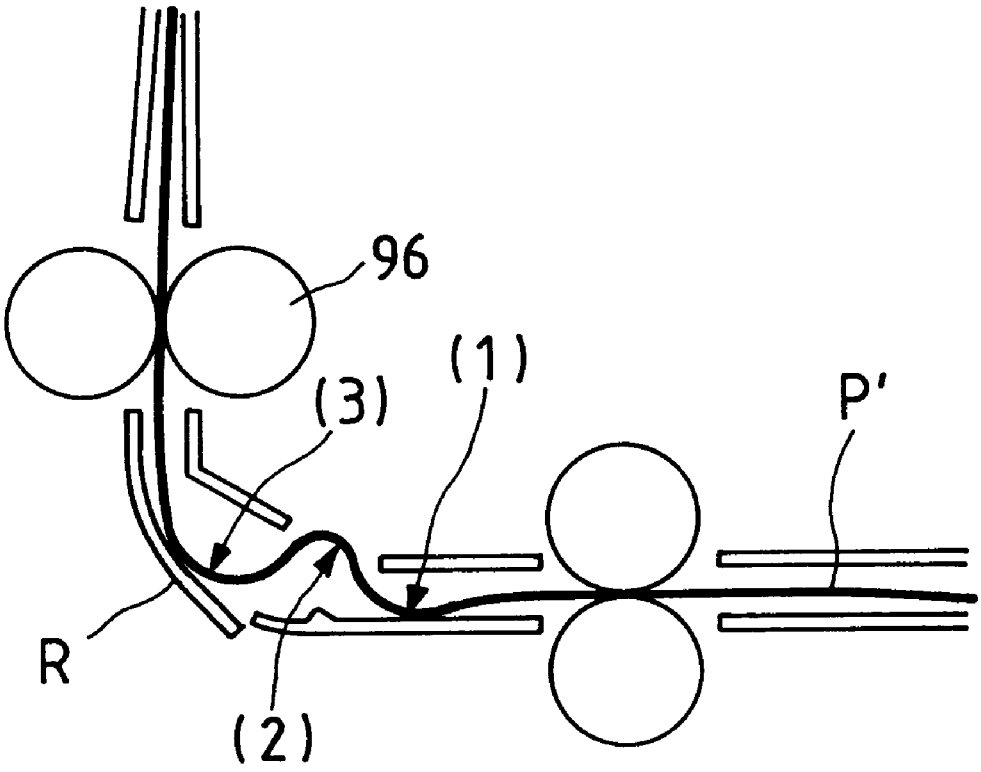
FIG. 17 PRIOR ART
FIG. 17 is an explanatory view showing a loop before registration roller pair of the conventional apparatus.

It is a feature of the present guides that when the recording paper collides with the registration rollers and forms a loop in a state in which the paper is obliquely moved, a loop amount differs in the width direction of the recording paper, but the guides are constructed so as to be also curved in accordance with such a loop amount. Namely, as shown in FIGS. 15A, 15B, and 15C, the guide arms at both edges can be almost independently swung [now, assuming that a rocking angle of the guide arm on the A side (FIG. 15A) in the diagram is set to a and that on the B side (FIG. 15B) is set to $\beta$, $\alpha>\beta$]. The guides can be also made contact with the side of a small loop of the recording paper and the urging force can be made act thereon. As mentioned above, the urging force of the guide almost uniformly acts in the width direction of the recording paper as a force for colliding the front edge of the recording paper with the registration nip (irrespective of the oblique movement of the recording paper). A degree of freedom of the recording paper in the width direction is improved due to the sheet 51T. Therefore, an ability to correct the oblique movement is improved as compared with that in case of the foregoing embodiment. Thus, a loop amount of the recording paper can be reduced (specifically speaking, 4 to 5 mm), so that a decrease in curl amount of the recording paper is further suppressed and the curl amount is more stabilized. Moreover, although a performance of the curling rollers can be also suppressed, this results in an improvement of a life and a reduction of an energy.

The movable guides of the swinging type for forming a loop space have been described above. However, the invention is not limited to such guides. For example, it is also possible to form a loop space by guides which move in parallel. Further, the invention is not limited to a construction such that the guides are pushed and widened by the recording paper itself but can also use a construction such that the guides are moved by an actuator such as a solenoid or the like. Although the invention has been described with respect to a construction comprising three rollers as a curling mechanism, the invention is not limited to such a construction but a similar effect can be also obtained by any other construction of a type such that the rollers are pressed onto a belt or the like.

Although the embodiments have been described with respect to the case where the recording paper on the transfer drum is held by the electrostatic adsorption, the invention is not limited to such a construction. For example, a mechanical holding method using a gripper or the like can be also used. The image forming means is also not limited to an electrophotograph but any other apparatus of the ink jet type, thermal transfer type, or the like can be used so long as it is needed by the recording paper conveying mechanism.

According to the invention, there is provided the image recording apparatus comprising: the conveying section for giving a curl to a sheet medium conveyed from a paper feed section and, after that, for passing the sheet medium through curved portion of the paper path, and for feeding out to the registration section; the registration section for once stopping the front edge of the sheet medium in order to correct the oblique movement of the sheet medium and to match the timing of the sheet medium with the timing of the image, for forming the loop, and for feeding the sheet medium to the image transfer section at a predetermined timing; and the transfer conveying section, arranged in the downstream of the registration section, for holding the sheet medium onto the surface and for conveying the sheet medium to the image transfer section, wherein by movably constructing a plurality of guide members forming the outside of the curved portion paper path, the loop shape before the registration roller pair becomes gentle and the sheet medium can be held onto the transfer drum in a stable state. Thus, a good transfer image without an image deviation, an image blank, or the like can be always obtained. A limitation about the kinds of sheet mediums which can be applied to the apparatus is reduced. The size of apparatus does not increase.

By providing a plurality of movable guides on the downstream side of the curling mechanism, the loop before the registration roller pair can be easily constructed so as not to exert an influence on the curl while maintaining the function as a conveying guide.

Further, by constructing at least one of the movable guides so that the movements of both edges in the paper width direction are independently performed (so as to have an equalizing mechanism), the movable guides are more uniformly come into contact with the sheet medium in the width direction thereof and the urging force acts as a force for colliding the front edge of the sheet medium with the registration nip, so that the ability to correct the oblique movement is improved. Therefore, the loop amount of the sheet medium can be reduced, so that a decrease in curl amount of the sheet medium is further suppressed and the sheet medium can be held onto the transfer drum in a more stable state.

What is claimed is:

1. An image forming apparatus in which a recording medium is conveyed to a recording medium holding member by a plurality of conveying means, the recording medium held by said recording medium holding member is conveyed to a transfer position which faces an image carrying member by a rotation of said recording medium holding member, and a visible image formed on the image carrying member is transferred onto the recording medium, wherein the image forming apparatus includes, a first conveying means from among said plurality of conveying means having a conveying roller pair, which is located at a most downstream position of said plurality of said conveying means in a conveying direction of the recording medium;

means for selectively performing rotation/stop of said conveying roller pair and contact/separation of a nip formed by said conveying roller pair;

a second conveying means of said plurality of conveying means;

means for selectively executing rotation/stop of said second conveying means of said plurality of conveying means, said second conveying means having curling conveying rollers for giving a curl to the recording medium in a recording medium wrapping direction of said recording medium holding member.

2. An apparatus according to claim 1, wherein a front edge portion of the recording medium after having passed through said curling conveying rollers is abutted downstream thereof and a loop shape formed on the abutted recording medium corresponds to the curling direction given by said curling conveying rollers.

3. An apparatus according to claim 2, wherein the conveyance of the recording medium by said plurality of conveying means is started at a time when a loop amount by the curl of the recording medium which have collided on a downstream side than said curling conveying rollers, is equal to or less than 3 mm.

4. An image recording apparatus comprising:

conveying means for feeding out a sheet medium supplied from a paper feed section to a registration portion through a paper path having a curved portion;

image forming means for forming an image on the fed sheet medium;

registration means for forming a loop space by once stopping a front edge of the sheet medium in order to correct an oblique movement of the sheet medium, and for feeding out the sheet medium to said image forming means; and a drum arranged downstream of said registration means in a sheet medium conveying direction for holding the sheet medium and conveying the sheet medium to said image forming means, wherein guide members for forming an outside of said paper path curved portion are moveable and the loop space is formed by a movement of at least one of said guide members, wherein at least one of said movable guide members is constructed so that movements of both edges in a paper width direction are independently executed.

5. An apparatus according to claim 4, further comprising a curling mechanism for giving a curled shape to the sheet medium in a direction along the drum, said curling mechanism provided on an upperstream side in the sheet medium conveying direction of the paper path curved portion in said conveying means.

6. An image forming apparatus comprising:

a rotating body by which a sheet is wound in a direction around a curved surface thereof and held;

image forming means for forming an image on the sheet held by said rotating body;

a conveyance path for guiding the sheet to said rotating body; and curl giving means provided in said conveyance path and for giving a curl to the sheet in the direction in which the sheet is wound around the curved surface of said rotating body; and oblique movement correcting means provided in said conveyance path and for curving the sheet with once stopping a front edge of the sheet in order to correct an oblique movement of the sheet being conveyed.

7. An apparatus according to claim 6, wherein said oblique movement correcting means curves the sheet in the direction in which said sheet is wound around the curved surface of said rotating body.

8. An apparatus according to claim 7, wherein said curl giving means functions as said oblique movement correcting means for once stopping the front edge of the sheet being conveyed.

9. An apparatus according to claim 7, wherein said oblique movement correcting means is provided one downstream side of said curl giving means in a sheet conveying direction.

10. An image forming apparatus according to claim 6, wherein said curl giving means comprises a primary roller and first and second secondary rollers for curling the sheet as it passes through said conveyance path, and whereafter the sheet continues through said conveyance path in a non-curled state but returns to a curled state when it is wound around the curved surface of said rotating body.

11. An image forming apparatus according to claim 10, wherein said primary roller is metal and said secondary rollers are made of an elastic member.

12. A sheet conveying apparatus, comprising:

conveying means for conveying a sheet;

oblique movement correcting means for correcting an oblique movement of the sheet by curving the sheet in a direction with once stopping a front edge of the sheet conveyed by said conveying means; and a guide member moveable with being pushed by the sheet curved by said oblique movement correcting means, said guide member being adapted so that movements of both edges in a sheet width direction are independently executed.

13. An apparatus according to claim 12, wherein said conveying means conveys the sheet along a conveyance path including a curved portion, and the sheet is further curved by said oblique movement correcting means in the direction of said curved portion.

14. An apparatus according to claim 13, further comprising curl giving means for giving a curl to the sheet being conveyed along said conveyance path in a direction opposite to said curve direction of said curved portion.

15. A sheet conveying apparatus, comprising:

conveying means for conveying a sheet;

oblique movement correcting means for correcting an oblique movement of the sheet by curving the sheet in a direction with once stopping a front edge of the sheet conveyed by said conveying means;

a first guide member moveable with being pushed by the sheet curved by said oblique movement correcting means; and a second guide member provided downstream of said first guide member in a sheet conveying direction and moveable with being pushed by the sheet curved by said oblique movement correcting means.

16. An apparatus according to claim 15, wherein said first guide member swings around a pivot at its upstream side, and said second guide member swings around a pivot at its downstream side.

17. An apparatus according to claim 15, wherein said conveying means conveys the sheet along a conveyance path including a curved portion, and the sheet is further curved by said oblique movement correcting means in the direction of said curved portion.

18. An apparatus according to claim 17, further comprising curl giving means for giving a curl to the sheet being conveyed along said conveyance path in a direction opposite to the direction of said curved portion.

19. An image forming apparatus, comprising:

a rotating body by which a sheet is wound in a direction around a curved surface thereof and held;

image forming means for forming an image on the sheet held by said rotating body;

means for defining a conveyance path for guiding the sheet to said rotating body; and curl giving means provided in said conveyance path defining means and for giving a curl to the sheet in the direction in which the sheet is wound around the curved surface of said rotating body, wherein said curl giving means comprises a primary roller and first and second secondary rollers for curling the sheet as it passes through said conveyance path defining means, and whereafter the sheet continues through said conveyance path in a non-curled state but returns to a curled state when it is wound around the curved surface of said rotating body.

20. An image forming apparatus according to claim 19, wherein said primary roller is metal and said secondary rollers are made of an elastic member.

21. An image forming apparatus, comprising:

convey means for conveying a sheet;

a pair of registration rollers for conveying the sheet, said registration roller pair temporally holding a tip end of the sheet conveyed by said convey means to bend the sheet for correcting a skew-feed thereof;

a guide member shiftable by pressing from the sheet bent by said registration roller pair, both end portions of said guide member in a sheet widthwise direction capable of shifting independently; and image forming means for forming an image on the sheet the skew-feed of which is corrected by said registration roller pair.

22. An image forming apparatus, comprising:

convey means for conveying a sheet;

a pair of registration rollers for conveying the sheet, said registration roller pair temporally holding a tip end of the sheet conveyed by said convey means to bend the sheet and form a loop portion for correcting a skew-feed thereof;

a first guide member shiftable by pressing from the loop portion of the sheet bent by said registration roller pair;

a second guide member disposed down-stream of said first guide member in a sheet convey direction and shiftable by pressing from the sheet bent by said registration roller pair; and an image forming means for forming an image on the sheet the skew-feed of which is corrected by said registration roller pair.

23. An image forming method in which a sheet is held on a hold means, then the hold means is rotated to transfer an image of an image bearing member onto the sheet at a transfer position for the image formation, comprising steps of:

correcting a skew-feed of the sheet by causing a tip end of the sheet to abut against a nip of a stopped pair of curl applying convey rollers, and forming a curl on the sheet in a direction surrounding the hold means by rotating the curl applying convey rollers;

forming a loop on the sheet by holding the tip end of sheet to which the curl is applied by the nip of a registration roller pair;

conveying the sheet to the hold means by rotating the registration roller pair; and separating one roller of the registration roller pair after the sheet tip end reaches the hold means.

* * * * *

UNITED STATES PATENT AND TRADEMARK OFFICE

CERTIFICATE OF CORRECTION

PATENT NO. : 5,933,697

DATED : August 3, 1999

INVENTOR(S): SHINICHI ONODERA, ET AL.

It is certified that error appears in the above-identified patent and that said Letters Patent is hereby corrected as shown below:

COLUMN 1,
Line 40, "have" should read --has the--.

COLUMN 2,
Line 38, "start" should read --starts--.

COLUMN 5,
Line 28, "locating" should read --located--.

COLUMN 9,
Line 9, "has" should read --have--.

COLUMN 12,
Line 23, "dashes" should read --dashed--.

COLUMN 13,
Line 32, "to a" should read --to ∝--.

COLUMN 14,
Line 39, "are" should be deleted.

UNITED STATES PATENT AND TRADEMARK OFFICE

CERTIFICATE OF CORRECTION

PATENT NO. : 5,933,697

DATED : August 3, 1999

INVENTOR(S): SHINICHI ONODERA, ET AL.

It is certified that error appears in the above-identified patent and that said Letters Patent is hereby corrected as shown below:

COLUMN 16,
Line 7, "one" should read --on a--.

Signed and Sealed this

Twenty-eighth Day of March, 2000

*Attest:*

Q. TODD DICKINSON

*Attesting Officer*

*Commissioner of Patents and Trademarks*